US010526559B2

(12) United States Patent
Salem et al.

(10) Patent No.: US 10,526,559 B2
(45) Date of Patent: Jan. 7, 2020

(54) AROMATIC DETERGENTS AND LUBRICATING COMPOSITIONS THEREOF

(71) Applicant: The Lubrizol Corporation, Wickliffe, OH (US)

(72) Inventors: Kamalakumari Kunchithapatham Salem, Mentor, OH (US); David J. Moreton, Milford (GB); Mohamed G. Fahmy, Eastlake, OH (US); Gary M. Walker, Allestree (GB); James P. Roski, Mentor, OH (US); Adam Cox, Novelty, OH (US); W. Preston Barnes, Chicago, IL (US); Ewan E. Delbridge, Concord Township, OH (US); Jason E. Melvin, Willowick, OH (US); Robert D. Dura, Broadview Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 118 days.

(21) Appl. No.: 15/552,617

(22) PCT Filed: Feb. 25, 2016

(86) PCT No.: PCT/US2016/019500
§ 371 (c)(1),
(2) Date: Aug. 22, 2017

(87) PCT Pub. No.: WO2016/138227
PCT Pub. Date: Sep. 1, 2016

(65) Prior Publication Data

US 2018/0051224 A1 Feb. 22, 2018

Related U.S. Application Data

(60) Provisional application No. 62/121,217, filed on Feb. 26, 2015.

(51) Int. Cl.

| | |
|---|---|
| ***C10M 159/22*** | (2006.01) |
| ***C10M 129/10*** | (2006.01) |
| ***C10M 129/14*** | (2006.01) |
| ***C10M 129/91*** | (2006.01) |
| ***C10M 129/12*** | (2006.01) |
| ***C10M 129/16*** | (2006.01) |

(52) U.S. Cl.
CPC ..... *C10M 129/10* (2013.01); *C10M 129/12* (2013.01); *C10M 129/14* (2013.01); *C10M 129/16* (2013.01); *C10M 129/91* (2013.01); *C10M 159/22* (2013.01); *C10M 2203/1006* (2013.01); *C10M 2203/1025* (2013.01); *C10M 2207/023* (2013.01); *C10M 2207/024* (2013.01); *C10M 2207/025* (2013.01); *C10M 2207/026* (2013.01); *C10M 2207/028* (2013.01); *C10M 2207/046* (2013.01); *C10M 2215/064* (2013.01); *C10M 2215/28* (2013.01); *C10M 2219/022* (2013.01); *C10M 2219/088* (2013.01); *C10M 2219/089* (2013.01); *C10N 2230/02* (2013.01); *C10N 2230/04* (2013.01); *C10N 2230/06* (2013.01); *C10N 2230/10* (2013.01); *C10N 2230/42* (2013.01); *C10N 2230/43* (2013.01); *C10N 2230/45* (2013.01); *C10N 2230/52* (2013.01); *C10N 2240/10* (2013.01); *C10N 2240/102* (2013.01)

(58) Field of Classification Search
CPC ..... C10M 159/20; C10M 159/22; C10N 2230/52
USPC ..... 508/586, 580
See application file for complete search history.

(56) References Cited

U.S. PATENT DOCUMENTS

| | | | | |
|---|---|---|---|---|
| 4,024,083 | A | 5/1977 | Kablaoui et al. | |
| 4,957,642 | A * | 9/1990 | Cleverley | C07C 37/66 508/572 |
| 5,211,863 | A | 5/1993 | Doner et al. | |
| 8,987,178 | B2 * | 3/2015 | Davies | C10M 129/10 508/280 |
| 2007/0049508 | A1 * | 3/2007 | Stonebraker | C10M 159/22 508/586 |
| 2010/0029527 | A1 * | 2/2010 | Campbell | C07C 37/14 508/567 |
| 2014/0130757 | A1 * | 5/2014 | Marsh | C10M 159/22 123/1 A |
| 2015/0119306 | A1 * | 4/2015 | Patil | C10M 105/18 508/580 |
| 2015/0119307 | A1 * | 4/2015 | Patil | C07C 41/16 508/580 |
| 2017/0267941 | A1 * | 9/2017 | Zhang | C10M 159/20 |

FOREIGN PATENT DOCUMENTS

| | | | |
|---|---|---|---|
| EP | 0323086 | A1 | 7/1989 |
| EP | 2682451 | A1 | 1/2014 |
| WO | 93/07242 | A1 | 4/1993 |
| WO | 2011/084658 | A1 | 7/2011 |

* cited by examiner

*Primary Examiner* — Ellen M McAvoy
(74) *Attorney, Agent, or Firm* — Michael Miller; Teresan Gilbert

(57) ABSTRACT

The disclosed technology provides a lubricating composition comprising an oil of lubricating viscosity and 0.2 wt % to 10 wt % of a salt of a hydroxyl functional aromatic compound. The disclosed technology further relates to a method of lubricating a mechanical device with the lubricant composition.

24 Claims, No Drawings

AROMATIC DETERGENTS AND LUBRICATING COMPOSITIONS THEREOF

CROSS REFERENCE TO RELATED APPLICATION

This application claims priority from PCT Application Serial No. PCT/US2016/19500 filed on Feb. 25, 2016, which claims the benefit of U.S. Provisional Application No. 62/121,217 filed on Feb. 26, 2015, both of which are incorporated in their entirety by reference herein.

The disclosed technology provides a lubricating composition comprising an oil of lubricating viscosity and 0.2 wt % to 10 wt % of a salt of an aromatic compound. The disclosed technology further relates to a method of lubricating a mechanical device with the lubricant composition.

BACKGROUND OF THE INVENTION

Phenol-based detergents are known. Among these are phenates based on phenolic monomers, linked with sulfur bridges or alkylene bridges such as methylene linkages derived from formaldehyde. The phenolic monomers themselves are typically substituted with an aliphatic hydrocarbyl group to provide a measure of oil solubility. The hydrocarbyl groups may be alkyl groups, and, historically, dodecylphenol (or propylene tetramer-substituted phenol) has been widely used. An early reference to basic sulfurized polyvalent metal phenates is U.S. Pat. No. 2,680,96, Walker et al., Jun. 1, 1954; see also U.S. Pat. No. 3,372,116, Meinhardt, Mar. 6, 1968.

Recently, however, certain alkylphenols and products prepared from them have come under increased scrutiny due to their association as potential endocrine disruptive materials. In particular, alkylphenol detergents which are based on phenols alkylated with oligomers of propylene, specifically propylene teramer (or tetrapropenyl), may contain residual alkyl phenol species. There is interest, therefore, in developing alkyl-substituted phenol detergents, for uses in lubricants, fuels, and as industrial additives, which contain a reduced or eliminated amount of dodecylphenol component and other substituted phenols having propylene oligomer substituents of 10 to 15 carbon atoms. Nevertheless, it is desirable that the products should have similar oil-solubility parameters as phenates prepared from C10-15 propylene oligomers.

There have been several efforts to prepare phenate detergents that do not contain Cn alkyl phenols derived from oligomers of propylene.

U.S. Application 2011/0190185 (Sinquin et al, Aug. 4, 2011) discloses an overbased salt of an oligomerized alkylhydroxyaromatic compound. The alkyl group is derived form an olefin mixture comprising propylene oligomers having an initial boiling point of at least about 195° C. and a final boiling point of greater than 325° C. The propylene oligomers may contain a distribution of carbon atoms that comprise at least about 50 weight percent of C 14 to C20 carbon atoms.

U.S. Application 2011/0124539 (Sinquin et al, May 26, 2011) discloses an overbased, sulfurized salt of an alkylated hydroxyaromatic compound. The alkyl substituent is a residue of at least one isomerized olefin having from 15 to about 99 wt. % branching. The hydroxyaromatic compound may be phenol, cresols, xylenols, or mixtures thereof.

U.S. Application 2011/0118160 (Campbell et al., May 19, 2011) discloses an alkylated hydroxyaromatic compound substantially free of endocrine disruptive chemicals. An alkylated hydroxyaromatic compound is prepared by reacting a hydroxyaromatic compound with at least one branched olefinic propylene oligomer having from about 20 to about 80 carbon atoms. Suitable hydroxyaromatic compounds include phenol, catechol, resorcinol, hydroquinone, pyrogallol, cresol, and the like.

U.S. Application 2010/0029529 (Campbell et al., Feb. 4, 2010) discloses an overbased salt of an oligomerized alkylhydroxyaromatic compound. The alkyl group is derived from an olefin mixture comprising propylene oligomers having an initial boiling point of at least about 195° C. and a final boiling point of no more than about 325° C. Suitable hydroxyaromatic compounds include phenol, catechol, resorcinol, hydroquinone, pyrogallol, cresol, and the like.

U.S. Application 2008/0269351 (Campbell et al., Oct. 30, 2008) discloses an alkylated hydroxyaromatic compound substantially free of endocrine disruptive chemicals, prepared by reacting a hydroxyaromatic compound with a branched olefinic oligomer having from about 20 to about 80 carbon atoms.

International Application WO 2013/059173 (Cook et al., 25 Apr. 2013) discloses an overbased salt of an oligomerized alkylhydroxyaromatic compound. The alkyl group is a combination of very short hydrocarbyl group (i.e. 1 to 8 carbon atoms) and a long hydrocarbyl group (at least about 25 carbon atoms). Suitable compounds include those made from a mixture of para-cresol and polyisobutylene-substituted phenol.

Other general technology includes that of U.S. Pat. No. 6,310,009 (Carrick et al., Oct. 30, 2001) which discloses salts of the general structure

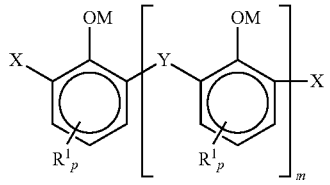

where R may be an alkyl group of 1 to 60 carbon atoms, e.g., 9 to 18 carbon atoms. It is understood that R1 will normally comprise a mixture of various chain lengths, so that the foregoing numbers will normally represent an average number of carbon atoms in the R1 groups (number average).

US 2007/0049508 (Stonebraker et al., Oct. 14, 2008) discloses a linear alkylphenol derived detergent substantially free of endocrine disruptive chemicals. It comprises a salt of a reaction product of (1) an olefin having at least 10 carbon atoms, where greater than 90 mole % of the olefin is a linear C20-C30 n-alpha olefin, and wherein less than 10 mole % of the olefin is a linear olefin of less than 20 carbon atoms, and less than 5 mole % of the olefin a branched chain olefin of 18 carbons or less, and (2) a hydroxyaromatic compound. There is a teaching that the hydroxyaromatic compound is selected from the group consisting of phenol, catechol, resorcinol, hydroquinone, and pyrogallol.

US 20050288194 (Small et al., 29 Dec. 2005) discloses a process for preparing an oligomeric phenolic detergent composition comprising contacting an oil soluble alkylphenol with an alkaline earth metal base, an alpha amino acid, and a C1 to C6 aldehyde, in the in the presence of a C2 to C6 alkylene glycol and a C2 to C4 carboxylic acid; and reacting under reactive conditions at a temperature of from about 150° C. to about 225° C. Paragraph [0030] teaches that the alkylphenols of may have two hydroxy groups on the benzene ring and thus be selected from alkyl catechol, alkyl resorcinol, and alkyl hydroquinone.

U.S. Pat. No. 6,235,688 (Small et al., 22 May 2001) disclose a non-thixotropic, sodium-free lubricant additive having from 10% to 50% of a liquid organic diluent and from 30% to 90% of a substituted hydrocarbaryl metal salt. At least 30 mole percent of the metal in the metal salt is lithium, and the salt is essentially free of sodium. The BN of the non-thixotropic lubricant additive attributable to the lithium is less than 150. This additive is useful for decreasing black sludge deposits and piston deposits.

US 2004/077507 (Lange et al., published 22 Apr. 2004) discloses an alkoxylated alkylphenol which have at least one long-chain alkyl radical having at least one tertiary or quaternary carbon atom are prepared and are used as fuel or lubricant additives in fuel and lubricant compositions. The alkoxylated alkylphenol may be useful for reducing sticking of valves and reducing the complete loss of compression on one or more cylinders of the internal combustion engine if—due to polymer deposits in the valve shaft—the spring forces are no longer sufficient to close the valves properly.

US 2014/130767 (Marsh et al., published 8 Jan. 2014) discloses an overbased sulfurised calcium phenate detergent additive, made from an aklylphenol, having oxyalkylated phenolic functional groups from unreacted alkylphenol starting material and lubricating compositions comprising the same.

International patent application WO/US2014/033323 (Zhang et al. filed 8 Apr. 2014) discloses a lubricating composition comprising: an oil of lubricating viscosity, and an oxyalkylated hydrocarbyl phenol, wherein the oxyalkylated hydrocarbyl phenol is substituted with at least one aliphatic hydrocarbyl group of 40 to 96 carbon atoms, and wherein the oxyalkylated hydrocarbyl phenol is substantially free of aromatic hydrocarbyl groups.

European Patent publication EP 2 374 866 A1 (Dambacher et al., published 12 Oct. 2011) relates to reducing deposits by employing a lubricating oil composition comprising (A) an oil of lubricating viscosity; and, (B) as an additive component, an oil-soluble mixture of oxyalkylated hydrocarbyl phenol condensates wherein the oxyalkyl groups have the formula —(R'O)n- where R' is an ethylene, a propylene or a butylene group; n is independently from 0 to 10; less than 45 mole % of the phenolic hydroxyl groups in the mixture are not oxyalkylated; and more than 55 mole % of the oxyalkyl groups in the mixture have the formula —R'O— where n is 1.

U.S. Pat. No. 5,510,043 (Noue, published 23 Apr. 1996) discloses a lubricating oil additive comprising an alkaline earth metal salt of a sulfurized monoalkylcatechol. The alkyl group of the monoalkylcatechol has 14 to 30 carbon atoms. The salt is reported as providing an internal combustion engine with antioxidant, friction-reducing and anti-abrasive properties at high temperature.

U.S. Pat. No. 4,221,673 (Robson et al., published 9 Sep. 1980) discloses a lubricating oil additive having an excellent rust preventive property can be produced by adding 10 to 50% by weight of an alkyldihydroxybenzene in the production of a sulfurized or non-sulfurized phenate. This patent, however, reports that the viscosity of the formed overbased sulfurized phenate increases with increasing the amount of addition of nonylcatechol and, when the amount of the nonylcatechol is 100%, the lubricating oil additive solidifies by the addition of calcium hydroxide. In the production of the nonsulfurized phenate, the product is a physical mixture of an alkylphenol with an alkyldihydroxybenzene, while in the production of the sulfurized phenate, the product is a compound comprising an alkylphenol and an alkyldihydroxybenzene bonded to said alkylphenol through sulfur crosslinking. Thus this patent does not take into consideration the use of the alkylcatechol or sulfurized alkylcatechol as such.

U.S. Pat. No. 4,643,838 (Liston et al, published 18 Sep. 1987) discloses liquid C18 to C24 monoalkyl catechols which are useful lubricating oil additives suitable for diesel engines. In particular, the liquid alkyl catechol which comprises a monoalkyl catechol wherein the alkyl substituent is a mixture of at least three of C18, C19, C20, C21, C22, C23 and C24 alkyl groups derived from the corresponding C18-C24 olefin mixture and with the proviso that the olefin mixture contains at least 30 molar percent branched olefins. The C18 to C24 monoalkyl catechols are disclosed as being friction modifiers. There is no teaching of employing the C18 to C24 monoalkyl catechols as a reagent for the preparation of a detergent.

U.S. Pat. No. 4,729,848 (Yamaguchi et al., published 8 Mar. 1988) discloses metal salts of alkyl catechol esters of dithiophosphoric acid suitable as additives in oil compositions are disclosed. Oil compositions containing the salts of such esters show improved extreme pressure/anti-wear and anti-oxidant properties. The metal includes zinc, and alkyl groups may have 15 to 18 carbon atoms. There is no teaching of employing the metal salts of alkyl catechol esters of dithiophosphoric acid as a detergent.

Salted catechols are known in non-lubricant technology such as those described in U.S. Pat. Nos. 4,058,472, 3,816,353, and 3,864,286.

U.S. Pat. No. 4,058,472 (Kablaoui, published 28 Jun., 1976) discloses A detergent composition containing as the surface active component from about 0.01 to about 10% by weight of the alkali metal or ammonium salts of a sulfonated $C_{14}$-$C_{18}$ alkyl catechol admixture, said catechol being present in the admixture in a weight ratio of from about 50 to 70 parts of the mono ($C_{14}$-$C_{18}$) alkyl catechol and from about 50 to 30 parts of the di ($C_{14}$-$C_{18}$) alkyl catechol, from about 40 to about 80-90% of an inorganic builder material, from 0 to 20% of an organic builder material, and from about 0.5 to about 5% of a special purpose component, said special purpose component being at least one member selected from the group consisting of a solubilizing agent, a bleaching agent and a brightener.

U.S. Pat. No. 3,816,353 (Sharman, published 5 May, 1970) discloses a method of washing fabric by contacting said fabric with an aqueous solution containing a detergent amount of detergent active material under conditions of time and temperature to effect substantial soil removal from the fabric, the improvement which comprises carrying out the washing at substantially neutral pH and in the absence of phosphate builder sand employing as detergent active material from about 0.01 percent to about 0.10 percent by weight of polysulfonated alkylphenols of the formula in which R is linear alkyl of 16 to 22 carbon atoms, X is H or an alkali metal, alkaline earth metal, ammonium, or a tertiary lower hydroxy alkyl amino cation, n is an average of 1.5 to 2, and not more than 20 mol percent of the sulfonated alkylphenols have R attached on the aromatic nucleus in a position para to OX.

U.S. Pat. No. 3,864,286 (Anderson, published 6 Nov. 1972) discloses a heavy-duty detergent composition comprising an organic water-soluble anionic, nonionic, ampholytic or zwitterionic detergent-active material and as a builder in an amount sufficient to enhance the detergency of the composition, a salt of a catechol disulfonate of a particular formula.

SUMMARY OF THE INVENTION

The disclosed technology, may solve at least one problem of providing a phenolic material with appropriate oil solubility, providing anti-wear performance, providing oxidation performance, viscosity performance, and detergency (characteristic of moderate chain length alkyl groups). In one embodiment the disclosed technology may also solve the problem of containing C12 alkyl phenol moieties i.e., the disclosed technology may be free from or substantially free from C12 alkyl phenol moieties.

As used herein, the transitional term "comprising", which is synonymous with "including", "containing", or "characterized by", is inclusive or open-ended and does not exclude additional, un-recited elements or method steps. However, in each recitation of "comprising" herein, it is intended that the term also encompass, as alternative embodiments, the phrases "consisting essentially of" and "consisting of", where "consisting of" excludes any element or step not specified and "consisting essentially of" permits the inclusion of additional un-recited elements or steps that do not materially affect the basic and novel, and essential characteristics of the composition or method under consideration.

As used herein the term "salt of an aromatic compound" is intended to include substituted and substituted compounds that have a hydroxyl group directly bonded aromatic group (within the definition of Hückel Rule 4π+2 electrons) such as catechol, or pyrrogallol, or resorcinol, or naphthalene based equivalents. It will be understood that where the aromatic compounds of the present invention are described as being anions or conjugate anions or forming a salt, the aromatic compound will have at least one hydroxyl group having an extractable hydrogen, namely, a hydrogen that will be removed from its adjoining oxygen to yield a conjugate anion.

As referred to herein, the TBN is measured using ASTM D2986-11.

The disclosed technology provides a lubricating composition comprising an oil of lubricating viscosity and 0.2 wt % to 10 wt % of a salt of an aromatic compound (typically chosen from an aromatic polyol compound or an oxyalkylated aromatic compound), wherein the salt comprises:

- an anion derived from
  - an aromatic group directly bonded to
  - at least one hydroxy group, and
  - at least one additional hydroxy group, or alkoxy group, wherein the alkoxy group is selected from a hydrocarbyl group, a hydroxy-substituted hydrocarbyl group, a (poly)ether group, or mixtures thereof, and
- a cation having
  - an atomic weight of at least 10 (typically the cation may be a metallic cation or a pnictogen cation).

For the disclosed technology, typically the cation is a metallic cation.

Optionally the anion may have at least one hydrocarbyl group.

In one embodiment, the anion may be oil soluble.

In another embodiment, the salt of the aromatic compound may be oil soluble.

In one embodiment the anion does not have an additional hydrocarbyl group. In one embodiment the anion does have an additional hydrocarbyl group.

In one embodiment the disclosed technology provides a lubricating composition comprising an oil of lubricating viscosity and 0.2 wt % to 10 wt % of a salt of an aromatic compound, wherein the salt comprises:

- an anion derived from
  - an aromatic group directly bonded to
  - at least one hydroxy group, and
  - at least one additional hydroxy group, or alkoxy group, wherein the alkoxy group is selected from a hydrocarbyl group, a hydroxy-substituted hydrocarbyl group, a (poly)ether group, or mixtures thereof, and
- a metallic cation having an atomic weight of at least 10 (typically an alkali metal or alkaline earth metal cation).

In one embodiment the disclosed technology provides a lubricating composition comprising an oil of lubricating viscosity and 0.2 wt % to 10 wt % of a salt of an aromatic compound, wherein the salt comprises:

- an anion derived from
  - an aromatic group directly bonded to
  - at least one hydroxy group, and
  - at least one alkoxy group, wherein the alkoxy group is selected from a hydrocarbyl group, a hydroxy-substituted hydrocarbyl group, a (poly)ether group, or mixtures thereof, and
- a metallic cation having an atomic weight of at least 10 (typically an alkali metal or alkaline earth metal cation).

The salt of an aromatic compound disclosed herein may contain less than 1 wt %, or less than 0.5 wt %, or less than 0.1 wt %. In one embodiment the salt of an aromatic compound disclosed herein is sulfur-free.

In one embodiment the disclosed technology provides a lubricating composition comprising an oil of lubricating viscosity and 0.2 wt % to 10 wt % of a sulfur-free salt of an aromatic compound (typically chosen from an aromatic polyol compound or an oxyalkylated aromatic compound), wherein the salt comprises:

- an anion derived from
  - an aromatic group directly bonded to
  - at least one hydroxy group, and
  - at least one additional hydroxy group, or alkoxy group, wherein the alkoxy group is selected from a hydrocarbyl group, a hydroxy-substituted hydrocarbyl group, a (poly)ether group, or mixtures thereof, and
- a cation having
- an atomic weight of at least 10 (typically the cation may be a metallic cation or a pnictogen cation).

The metallic cation may be from an alkaline earth metal such as calcium, barium or magnesium (typically calcium or magnesium, often calcium), or an alkali metal such as sodium, or potassium (typically sodium). Typically the metallic cation may be from an alkaline earth metal such as calcium, or an alkali metal such as sodium.

In one embodiment the salt of the aromatic compound may be obtained/obtainable by reacting the aromatic compound with a metal base.

In one embodiment the salt of an aromatic compound may be obtained/obtainable by (i) reacting the aromatic compound with an epoxide, or a (poly)ether to form an intermediate (or an aromatic polyol), and (ii) reacting the intermediate with a metal base.

The salt of the aromatic compound of the disclosed technology in one embodiment does not contain sulfonate functional group.

The salt of the aromatic compound of the disclosed technology in one embodiment does not contain phosphate functional group.

The salt of the aromatic compound of the disclosed technology in one embodiment does not contain borate functional group.

The salt of the aromatic compound of the disclosed technology in one embodiment does contain borate functional group.

The salts described above can be boronated by processes know to those skilled in the art. Boration can be accomplished either prior to, or after, the overbasing step. The boration can be accomplished by a number of boronating agents; materials useful for boration would include boric acid, metaboric acid, orthoboric acid, alkyl borates, boron halides, polymers of boron, esters of boron and similar materials. When present, the boron content of the salt may typically be 0.1 wt % to 5 wt %, or 1 wt % to 5 wt %, or 2 wt % to 4 wt %.

The salt of the aromatic compound of the disclosed technology in one embodiment may be formed from an anion composed of carbon, hydrogen, oxygen, boron and nitrogen; and a metallic cation.

The salt of the aromatic compound of the disclosed technology in one embodiment may be formed from an anion composed of carbon, hydrogen, oxygen and nitrogen; and a metallic cation.

The salt of the aromatic compound of the disclosed technology in one embodiment may be formed from an anion composed of carbon, hydrogen, and oxygen; and a metallic cation (typically calcium, magnesium or sodium, often calcium).

In different embodiments the salt of an aromatic compound of the disclosed technology may be present in an amount ranging from 0.2 wt % to 10 wt %, or 0.3 to 8 wt %, or 0.4 to 5 wt % of the lubricating composition. Typically the aromatic compound may be present in an amount from 0.5 wt % to 3 wt %, or 1 wt % to 2 wt % of the lubricating composition.

The disclosed technology in one embodiment provides a process for the preparation of a salt of the aromatic compound comprising: reacting the aromatic compound with a metal base.

The disclosed technology in one embodiment provides a process for the preparation of a salt of an aromatic compound with an epoxide, or a (poly)ether to form an intermediate (or an aromatic polyol), and reacting the intermediate with a metal base.

The process to prepare the intermediate may be carried out a reaction temperature of 70° C. to 175° C., or 90° C. to 160° C., or 95° C. to 150° C.

The formation of the intermediate may be performed in the presence or absence of solvent. The solvent may include a hydrocarbon such as toluene, xylene, diluent oil, cyclohexane, or mixtures thereof.

In one embodiment the process to prepare the intermediate is performed in the presence of a solvent.

Optionally the solvent is removed before reacting of the intermediate with the metal base.

The formation of the salt may be performed by reacting the intermediate or (aromatic polyol) with metal base, typically at a reaction temperature of 70° C. to 175° C., or 90° C. to 160° C., or 95° C. to 150° C.

The metal base may include sodium hydroxide, potassium hydroxide, calcium hydroxide, magnesium hydroxide, magnesium oxide, calcium oxide, sodium oxide. Typically the metal base may be calcium hydroxide or sodium hydroxide.

As used herein the expression "Pnictogens" (the term being derived from Greek pnigein, to choke or stifle) includes the elements in column 15 (or Va) of the periodic table, the column headed by nitrogen. The non-metallic pnictogens include nitrogen and phosphorus (typically nitrogen).

The pnictogen cation may be derivable from a compound with a primary amine, a secondary amine, a tertiary amine, or mixtures thereof. Typically the amine salt may be derived from a secondary or a tertiary amine.

The salt of an aromatic compound may be a neutral salt, or an overbased salt.

The TBN of the neutral salt may be 50 to 250, or 70 to 165 mg KOH/g on an oil-free basis.

On an oil-containing basis, the TBN of the neutral salt may be 130 to 200 mg KOH/g, or 150 to mg KOH/g; and the metal base may range from 0.7 to less than 2.

The TBN of the overbased salt may be 200 to 750, or 300 to 600 on an oil-free basis.

On an oil-containing basis, the TBN of the overbased salt may be greater than 200 to 400 (or 200 to 312), or up to 350 mg KOH/g; and the metal ratio may range from 2 to 5, or 2 to 4.7.

In one embodiment, the salt of an aromatic compound may form a "hybrid" detergent with minor amounts of one or more other surfactant substrate systems including phenate and/or sulfonate and/or salicylate and/or sulfuric acid substrates.

The lubricating composition disclosed herein may have a SAE viscosity grade of XW-Y, wherein X may be 0, 5, 10, or 15; and Y may be 16, 20, 30, or 40.

The oil of lubricating viscosity may comprise an API Group I, II, III, IV, V, or mixtures thereof base oil.

The oil of lubricating viscosity may comprise an API Group I, II, III, IV, or mixtures thereof base oil.

The oil of lubricating viscosity may comprise an API Group II, III, IV, or mixtures thereof base oil.

The oil of lubricating viscosity may comprise an API Group II, III, or mixtures thereof base oil.

The disclosed technology in one embodiment provides a method of lubricating a mechanical device with the lubricating composition disclosed herein.

In one embodiment the disclosed technology provides a method of lubricating an internal combustion engine comprising supplying to the internal combustion engine a lubricating composition of a lubricating disclosed herein.

The internal combustion engine may have a steel surface on a cylinder bore, a cylinder block, or a piston ring.

The internal combustion engine may be a heavy duty diesel internal combustion engine.

The heavy duty diesel internal combustion engine may have a "technically permissible maximum laden mass" over 3,500 kg. The engine may be a compression ignition engine or a positive ignition natural gas (NG) or LPG (liquefied petroleum gas) engine. The internal combustion engine may be a passenger car internal combustion engine. The passenger car engine may be operated on unleaded gasoline. Unleaded gasoline is well known in the art and is defined by British Standard BS EN 228:2008 (entitled "Automotive Fuels—Unleaded Petrol—Requirements and Test Methods").

The passenger car internal combustion engine may have a reference mass not exceeding 2610 kg.

The disclosed technology may also provide for a method of controlling soot formation in a 4-stroke compression ignition engine or a positive ignition natural gas (NG) or LPG engine comprising supplying to the engine a lubricating composition disclosed herein.

In one embodiment the disclosed technology provides a method of lubricating a 2-stroke or 4-stroke marine diesel internal combustion engine comprising supplying to the internal combustion engine a lubricating composition disclosed herein. The lubricating composition is typically used to lubricate the 2-stroke marine diesel cylinder liner.

The two-stroke marine diesel engine may be a 2-stroke, cross-head slow-speed compression-ignited engine usually has a speed of below 200 rpm, such as, for example, 10-200 rpm or 60-200 rpm.

The fuel of the 2-stroke marine diesel engine may contain a sulfur content of up to 5000 ppm, or up to 3000, or up to 1000 ppm of sulfur. For example the sulfur content may be 200 ppm to 5000 ppm, or 500 ppm to 4500 ppm, or 750 ppm to 2000 ppm.

The disclosed technology also provides for the use of the detergent disclosed herein in a lubricating composition to provide at least one of anti-wear performance, providing oxidation performance, viscosity performance, and detergency to the lubricant.

In one embodiment the disclosed technology provides for the use of a salt of an aromatic compound disclosed herein in a lubricating composition to provide at least one of anti-wear performance, oxidation performance, and detergency.

In one embodiment the disclosed technology provides for the use of a salt of an aromatic compound disclosed herein in an internal combustion engine lubricating composition to provide at least one of anti-wear performance, oxidation performance, and detergency.

DETAILED DESCRIPTION OF THE INVENTION

The disclosed technology provides a lubricating composition, a method for lubricating an internal combustion engine and the use as disclosed above.

Salt of an Aromatic Compound

As disclosed above, the metallic cation may be from an alkaline earth metal, or an alkali metal. The metallic cation may also be from other mono- or di- or tri- or tetra-valent metals or a mixture thereof. For example the metallic cation may also be derived from copper, or zinc.

Typically the metallic cation may be derived from potassium, sodium, magnesium, calcium, barium, or mixtures thereof. For example the metallic cation may be derived from sodium or calcium.

The metallic cation may be derived from a metal base such as a metal base of a hydroxide, an oxide, carbonate, or bicarbonate. Typically the metal base may be a hydroxide or an oxide. For example the metallic cation may be derived from calcium hydroxide, calcium oxide, sodium hydroxide, sodium oxide, magnesium hydroxide or magnesium oxide.

In one embodiment, the aromatic compound forming the salt may be an aromatic diol compound, an aromatic triol compound, an alkylether of said aromatic diol or triol compound, or combinations thereof.

In one embodiment the aromatic compound forming the salt may be represented by the formula:

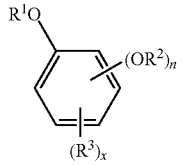

wherein n may be 1 or 2, x may be 0 to 2, $R^1$ or $R^2$ may be hydrogen or $—(CH_2CHR^4—O—)_mR^5$, $R^3$ may be hydrogen, a hydrocarbyl group (typically containing 1 to 150 carbon atoms (or 1 to 80, 10 to 40, or 30 to 100, or 40 to 96 carbon atoms) or a hydrocarbyl group containing 6 to 36, 10 to 30 or 12 to 24 carbon atoms, or an acyl group, $—C(=O)XR^6$, or $—(CH_2CHR^4—O—)_mR^5$, $R^4$ may be hydrogen or a hydrocarbyl group containing 1 to 32, or 1 to 24, or 1 to 16, or 2 to 16, or 5 to 32, or 6 to 32, or 6 to 24, or 8 to 24, or 8 to 16, or 1 to 4, (or 1 to 2) carbon atoms, or $CH_2OR^8$, $R^5$ may be hydrogen or a hydrocarbyl group (typically containing 1 to 24, or 1 to 12 carbon atoms), or $—(C=O)R^7$, $R^6$ may be a hydrocarbyl group containing 1 to 24, or 1 to 18, or 3 to 12 carbon atoms or $—(CH_2CHR^4—O—)_mR^5$, and m=1 to 20, or 5 to 18, or 1 to 4 (or 1 to 2, or 1), $R^7$ may be a hydrocarbyl group (typically containing 1 to 24, or 1 to 12, carbon atoms), $R^8$ may be hydrogen or a hydrocarbyl group containing 1 to 24, or 4 to 20, or 10 to 18 carbon atoms, X may be —O—, $—NR^9—$, $R^9$ may be hydrogen or a hydrocarbyl group containing 1 to 24 carbon atoms, and m=1 to 20, or 5 to 18, or 1 to 4 (or 1 to 2, or 1)

with the proviso that at least one of $R^1$, $R^2$ and $R^3$ is not hydrogen and at least one of $R^1$, $R^2$, $R^5$ or $R^8$ is hydrogen.

In certain embodiments when x may be 2, each $R^3$ may be selected such that they form a 5- or 6-membered hydrocarbyl ring; the hydrocarbyl ring may be saturated, partially unsaturated, or unsaturated so as to form a second aromatic ring.

In certain embodiments, when n=2, each $R^2$ may be taken together to form a 5-membered or 6-membered ring.

In one embodiment the aromatic compound forming the salt may be represented by the formula:

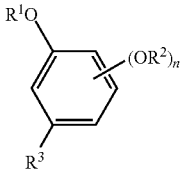

wherein n may be 1 or 2, $R^1$ may be hydrogen, a hydrocarbyl group containing 1 to 32, or 1 to 24, or 1 to 16, or 2 to 16, or 8 to 16, or 1 to 4, (or 1 to 2) carbon atoms, or $—(CH_2CHR^4—O—)_mR^5$, $R^2$ may be hydrogen, $R^3$ may be hydrogen or a hydrocarbyl group (typically containing 1 to 150 carbon atoms (or 1 to 80, 10 to 40, or 30 to 100, or 40 to 96 carbon atoms) or a hydrocarbyl group containing 6 to 36, 10 to 30 or 12 to 24 carbon atoms, $R^4$ may be hydrogen or a hydrocarbyl group containing 1 to 32, or 1 to 24, or 1 to 16, or 2 to 16, or 5 to 32, or 6 to 32, or 6 to 24, or 8 to 24, or 8 to 16, or 1 to 4, (or 1 to 2) carbon atoms, or $CH_2OR^8$, $R^5$ may be hydrogen or a hydrocarbyl group (typically containing 1 to 24, or 1 to 12 carbon atoms), or —(C═O)$R^7$, $R^7$ may be a hydrocarbyl group (typically containing 1 to 24, or 1 to 12, carbon atoms), $R^8$ may be hydrogen or a hydrocarbyl group containing 1 to 24, or 4 to 20, or 10 to 18 carbon atoms, and m=1 to 20, or 5 to 18, or 1 to 4 (or 1 to 2, or 1).

Typically when $R^3$ may be hydrogen $R^1$ may be not hydrogen.

Typically when $R^3$ may be a hydrocarbyl group, $R^1$ may be hydrogen or —$(CH_2CHR^5—O—)_mR^6$.

In one embodiment $R^3$ may be hydrogen.

In one embodiment $R^3$ may be hydrogen, x may be 1 and n may be 1.

In one embodiment the aromatic compound forming the salt may be represented by the formula:

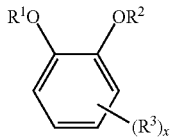

wherein x may be 0, 1 or 2, $R^1$ may be hydrogen, a hydrocarbyl group containing 1 to 32, or 1 to 24, or 1 to 16, or 2 to 16, or 8 to 16, or 1 to 4, (or 1 to 2) carbon atoms, or —$(CH_2CHR^4—O—)_mR^5$, $R^2$ may be hydrogen, a hydrocarbyl group containing 1 to 32, or 1 to 24, or 1 to 16, or 2 to 16, or 8 to 16, or 1 to 4, (or 1 to 2) carbon atoms, or —$(CH_2CHR^4—O—)_mR^5$, $R^3$ may be a hydrocarbyl group (typically containing 1 to 150 carbon atoms (or 1 to 80, 10 to 40, or 30 to 100, or 40 to 96 carbon atoms) or a hydrocarbyl group containing 6 to 36, 10 to 30 or 12 to 24 carbon atoms, $R^4$ may be hydrogen or a hydrocarbyl group containing 1 to 32, or 1 to 24, or 1 to 16, or 2 to 16, or 5 to 32, or 6 to 32, or 6 to 24, or 8 to 24, or 8 to 16, or 1 to 4, (or 1 to 2) carbon atoms, or $CH_2OR^8$, $R^5$ may be hydrogen or a hydrocarbyl group (typically containing 1 to 24, or 1 to 12 carbon atoms), or —(C═O)$R^7$, $R^7$ may be a hydrocarbyl group (typically containing 1 to 24, or 1 to 12, carbon atoms), $R^8$ may be hydrogen or a hydrocarbyl group containing 1 to 24, or 4 to 20, or 10 to 18 carbon atoms, and m=1 to 20, or 5 to 18, or 1 to 4 (or 1 to 2, or 1)

with the proviso that at least one of $R^1$, $R^2$ or $R^5$ is a hydrogen.

In one embodiment the aromatic compound forming the salt may be represented by the formula:

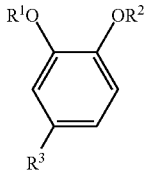

wherein $R^1$ may be hydrogen, a hydrocarbyl group containing 1 to 32, or 1 to 24, or 1 to 16, or 2 to 16, or 8 to 16, or 1 to 4, (or 1 to 2) carbon atoms, or —$(CH_2CHR^4—O—)_mR^5$, $R^2$ may be hydrogen, a hydrocarbyl group containing 1 to 32, or 1 to 24, or 1 to 16, or 2 to 16, or 8 to 16, or 1 to 4, (or 1 to 2) carbon atoms, or —$(CH_2CHR^4—O—)_mR^5$, $R^3$ may be a hydrocarbyl group (typically containing 1 to 150 carbon atoms (or 1 to 80, 10 to 40, or 30 to 100, or 40 to 96 carbon atoms) or a hydrocarbyl group containing 6 to 36, 10 to 30 or 12 to 24 carbon atoms, $R^4$ may be hydrogen or a hydrocarbyl group containing 1 to 32, or 1 to 24, or 1 to 16, or 2 to 16, or 5 to 32, or 6 to 32, or 6 to 24, or 8 to 24, or 8 to 16, or 1 to 4, (or 1 to 2) carbon atoms, or $CH_2OR^8$, $R^5$ may be hydrogen or a hydrocarbyl group (typically containing 1 to 24, or 1 to 12 carbon atoms), or —(C═O)$R^7$, $R^7$ may be a hydrocarbyl group (typically containing 1 to 24, or 1 to 12, carbon atoms), $R^8$ may be hydrogen or a hydrocarbyl group containing 1 to 24, or 4 to 20, or 10 to 18 carbon atoms, and m=1 to 20, or 5 to 18, or 1 to 4 (or 1 to 2, or 1)

with the proviso that at least one of $R^2$ or $R^5$ is hydrogen.

In each of the formulae above, in one embodiment $R^3$ is hydrogen.

In each of the formulae above, in one embodiment $R^3$ is a hydrocarbyl group disclosed therein.

In one embodiment the aromatic compound forming the salt may be a trihydroxy compound represented by the formula:

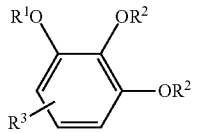

$R^1$ may be hydrogen, each $R^2$ independently may be hydrogen, a hydrocarbyl group containing 1 to 32, or 1 to 24, or 1 to 16, or 2 to 16, or 8 to 16, or 1 to 4, (or 1 to 2) carbon atoms, or —$(CH_2CHR^4—O—)_mR^5$, $R^3$ may be hydrogen, a hydrocarbyl group (typically containing 1 to 150 carbon atoms (or 1 to 80, 10 to 40, or 30 to 100, or 40 to 96 carbon atoms) or a hydrocarbyl group containing 6 to 36, 10 to 30 or 12 to 24 carbon atoms, or an acyl group, —C(═O)X$R^6$, $R^4$ may be hydrogen or a hydrocarbyl group containing 1 to 32, or 1 to 24, or 1 to 16, or 2 to 16, or 5 to 32, or 6 to 32, or 6 to 24, or 8 to 24, or 8 to 16, or 1 to 4, (or 1 to 2) carbon atoms, or $CH_2OR^8$, $R^5$ may be hydrogen or a hydrocarbyl group (typically containing 1 to 24, or 1 to 12 carbon atoms), or —(C═O)$R^7$, $R^6$ may be a hydrocarbyl group containing 1 to 24, or 1 to 18, or 3 to 12 carbon atoms or —$(CH_2CHR^4—O—)_mR^5$, $R^7$ may be a hydrocarbyl group (typically containing 1 to 24, or 1 to 12, carbon atoms), $R^8$ may be hydrogen or a hydrocarbyl group containing 1 to 24, or 4 to 20, or 10 to 18 carbon atoms, and X may be —O—, —$NR^9$—, $R^9$ may be hydrogen or a hydrocarbyl group containing 1 to 24 carbon atoms, and m=1 to 20, or 5 to 18, or 1 to 4 (or 1 to 2, or 1), with the proviso that at least one of $R^2$ or $R^3$ is not hydrogen.

Typically when $R^3$ may be hydrogen $R^2$ may be not hydrogen.

Typically when $R^3$ may be a hydrocarbyl group, $R^2$ may be hydrogen or $—(CH_2CHR^5—O—)_mR^6$.

In one embodiment $R^3$ may be hydrogen.

In one embodiment $R^3$ may be hydrogen, x may be 1 and n may be 1.

For the pyrogallol based aromatic compound the $—OR^1$ and $—OR^2$ groups may be exchanged on the formula shown above. A person skilled in the art would realize that the alkoxylation of pyrogallol can occur on any of the three hydroxyl groups.

In one embodiment, the trihydroxyaromatic compound may be derived from gallic acid, esters of gallic acid, amides of gallic acid or mixtures thereof. The gallic acid derivatives of the disclosed technology may be represented by the formula:

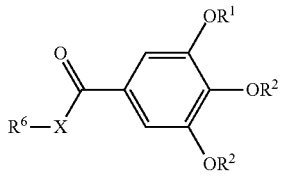

$R^1$ may be hydrogen, each $R^2$ independently may be hydrogen, a hydrocarbyl group containing 1 to 32, or 1 to 24, or 1 to 16, or 2 to 16, or 8 to 16, or 1 to 4, (or 1 to 2) carbon atoms, or $—(CH_2CHR^4—O—)_mR^5$, $R^4$ may be hydrogen or a hydrocarbyl group containing 1 to 32, or 1 to 24, or 1 to 16, or 2 to 16, or 5 to 32, or 6 to 32, or 6 to 24, or 8 to 24, or 8 to 16, or 1 to 4, (or 1 to 2) carbon atoms, or $CH_2OR^8$, $R^5$ may be hydrogen or a hydrocarbyl group (typically containing 1 to 24, or 1 to 12 carbon atoms), or $—(C═O)R^7$, and $R^6$ may be a hydrocarbyl group containing 1 to 24, or 1 to 18, or 3 to 12 carbon atoms or $—(CH_2CHR^4—O—)_mR^5$, $R^7$ may be a hydrocarbyl group (typically containing 1 to 24, or 1 to 12, carbon atoms), $R^8$ may be hydrogen or a hydrocarbyl group containing 1 to 24, or 4 to 20, or 10 to 18 carbon atoms, and X may be —O—, $—NR^9—$, $R^9$ may be hydrogen or a hydrocarbyl group containing 1 to 24 carbon atoms, and m=1 to 20, or 5 to 18, or 1 to 4 (or 1 to 2, or 1).

In one embodiment the aromatic compound forming the salt may be comprised of two or more edge sharing rings substituted with one or more hydroxy groups and at least one additional hydroxy group, or alkoxy group, wherein the alkoxy group may be selected from a hydrocarbyl group, a hydroxy-substituted hydrocarbyl group, a (poly)ether group, or mixtures thereof.

In one embodiment the aromatic compound forming the salt comprises two or more edge-sharing rings may be represented by the formulae:

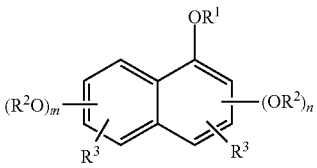

or

-continued

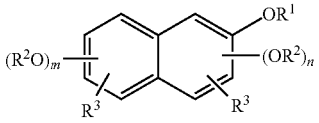

where $R^1$ may be hydrogen, each $R^2$ independently may be hydrogen, a hydrocarbyl group containing 1 to 32, or 1 to 24, or 1 to 16, or 2 to 16, or 8 to 16, or 1 to 4, (or 1 to 2) carbon atoms, or $—(CH_2CHR^4—O—)_mR^5$, each $R^3$ independently may be hydrogen, a hydrocarbyl group (typically containing 1 to 150 carbon atoms (or 1 to 80, 10 to 40, or 30 to 100, or 40 to 96 carbon atoms) or a hydrocarbyl group containing 6 to 36, 10 to 30 or 12 to 24 carbon atoms, or an acyl group $—C(═O)OR^6$ $R^4$ may be hydrogen or a hydrocarbyl group containing 1 to 32, or 1 to 24, or 1 to 16, or 2 to 16, or 5 to 32, or 6 to 32, or 6 to 24, or 8 to 24, or 8 to 16, or 1 to 4, (or 1 to 2) carbon atoms, or $CH_2OR^8$, $R^5$ may be hydrogen or a hydrocarbyl group (typically containing 1 to 24, or 1 to 12 carbon atoms), or $—(C═O)R^7$, $R^6$ may be a hydrocarbyl group containing 1 to 24, or 1 to 18, or 3 to 12 carbon atoms or $—(CH_2CHR^4—O—)_mR^5$, $R^7$ may be a hydrocarbyl group (typically containing 1 to 24, or 1 to 12, carbon atoms), $R^8$ may be hydrogen or a hydrocarbyl group containing 1 to 24, or 4 to 20, or 10 to 18 carbon atoms, and m may be 0, 1 or 2, n may be 0, 1, or 2, such that m+n=1 or more, with the proviso that at least one of $R^2$ or $R^3$ may be not hydrogen.

In one embodiment the aromatic compound forming the salt may be derived from catechol (i.e. pyrocatechol); resorcinol; hydroquinone; pyrogallol; hydrocarbyl esters of gallic acid; naphthalene-2,3-diol; naphthalene-1,8-diol; naphthalene-1,5-diol; naphthalene-1,7-diol; naphthalene-2,6-diol; mono- or di-alkylated derivatives of the same; or mixtures thereof.

The aromatic compound forming the salt may be prepared by reacting an aromatic compound with an alkylene oxide (typically ethylene oxide, propylene oxide or butylene oxide), optionally in the presence of a base catalyst. Typically the reaction occurs in the presence of a base catalyst.

The base catalyst may include sodium chloroacetate, sodium hydride sodium hydroxide, or potassium hydroxide.

The hydrocarbyl group (also represented by $R^3$) may be linear or branched, typically with at least one branching point. The aliphatic hydrocarbyl group typically has one, although it may in some embodiments be desirable to have to $R^3$ groups.

It is believed that the aromatic compound and the metal of the metal base form a salt by interaction of a cation metal with an anion formed by either a —OH bonded directly to the aromatic group, or through a —OH group along the oxyalkylated group.

When m=1, the alkoxy group may be formed from reacting an aromatic compound with an epoxide such as a cyclic ether or oxirane with a hydroxyl group of the aromatic compound. Typically the oxirane may be a 2-alkyloxirane having 8 to 20, or 12 to 18 carbon atoms. Examples of 2-alkyloxirane include 2-octyloxirane, 2-nonyloxirane, 2-decyloxirane, 2-undecyloxirane, 2-dodecyloxirane, 2-triadecyloxirane, 2-tetradecyloxirane, 2-pentadecyloxirane, 2-hexdecyloxirane, 2-heptadecyloxirane, 2-octadecyloxirane, 2-nonadecyloxirane, or 2-eicosyloxirane, or mixtures thereof.

When m=2 or more the alkoxy group may be formed from reacting a polyether, or polyalkylene glycol with hydroxyl group of the aromatic compound. The polyether or polyalkylene glycol may be ethylene, propylene, butylene group, or mixtures thereof, with the proviso that if $R^1$ comprises ethylene groups the resultant aromatic compound may be a random or block copolymer derived from ethylene glycol and either (i) propylene glycol or (ii) butylene glycol.

In one embodiment the salt of an aromatic compound is formed in the absence of an alpha amino acid, and/or a C1 to C6 aldehyde.

Pnictogen Cation

The amine that can be used to prepare a pnictogen is known to a skilled person and is intended to include an amine capable of salting with a protic acid.

The amine may be an alkyl amine, typically a di- or tri-alkyl amine. The alkyl amine may have alkyl groups having 1 to 30, or 2 to 20, or 3 to 10 carbon atoms. Examples of a dialkyl amine include diethylamine, dipropylamine, dibutylamine, dipentylamine, dihexylamine, di-(2-ethylhexyl)amine, di-decylamine, di-dodecylamine, di-stearylamine, di-oleylamine, di-eicosylamine, or mixtures thereof. Examples of a trialkyl amine include triethylamine, tripropyl amine, tributyl amine, tripentyl amine, trihexylamine, tri-(2-ethylhexyl)amine, tri-decylamine, tri-dodecylamine, tri-stearylamine, tri-oleylamine, tri-eicosylamine, or mixtures thereof.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the amine salt includes an amine with C14 to C18 tertiary alkyl primary amines or mixtures thereof. In one embodiment the phosphorus acid amine salt includes an amine with C18 to C22 tertiary alkyl primary amines or mixtures thereof.

In one embodiment the amine salt may be in the form of a quaternary ammonium salt. Examples of quaternary ammonium salts containing a hydroxyalkyl group, and methods for their synthesis, are disclosed in U.S. Pat. No. 3,962,104, see column 1 line 16 through column 2 line 49; column 8 lines 13 through 49, and the Examples. In certain embodiments, the quaternary ammonium compound is derived from a monoamine by means of alkylation, i.e., from a tertiary amine having only a single amino group, that is, having no additional amine nitrogen atoms in any of the three hydrocarbyl groups or substituted hydrocarbyl groups attached to the tertiary amine nitrogen. In certain embodiments there are no additional amine nitrogen atoms in any of the hydrocarbyl groups or substituted hydrocarbyl groups attached to the central nitrogen in the quaternary ammonium ion. The tetraalkylammonium hydroxide may contain alkyl groups having 1 to 30, or 2 to 20, or 3 to 10 carbon atoms. The tetraalkylammonium hydroxide may include tetrapropylammonium hydroxide, tetrabutylammonium hydroxide, tetrapentylammonium hydroxide, tetrahexylammonium hydroxide, tetra-2-ethylhexyl ammonium hydroxide, or tetradecylammonium hydroxide, or mixtures thereof.

The amine may be quaternised with a quaternising agent, or mixtures thereof.

The nitrogen or oxygen containing compounds may further include aminoalkyl substituted heterocyclic compounds such as 1-(3-aminopropyl)imidazole and 4-(3-aminopropyl) morpholine, 1-(2-aminoethyl)piperidine, 3,3-diamino-N-methyldipropylamine, or 3,3-aminobis(N,N-dimethylpropylamine).

Other examples of quaternary ammonium salt and methods for preparing the same are described in the following patents, which are hereby incorporated by reference, U.S. Pat. Nos. 4,253,980, 3,778,371, 4,171,959, 4,326,973, 4,338,206, and 5,254,138.

When the amine salt is derived from an aromatic amine, the aromatic amine may form an ion such as a pyridinium ion, or an imidazolium ion. Certain quaternary phosphonium salts may be prepared by the reaction of phosphine with aldehydes and a halide e.g., tetrakis(hydroxymethyl)phosphonium halide (typically chloride).

A quaternary pnictogen halide compound may be a commercially available material, or it may be prepared by reaction of a tertiary amine with a hydrocarbyl halide, by known techniques. This reaction may be done in a separate vessel or in the same vessel in which it is subsequently (or simultaneously) reacted with the oil-soluble acidic compound, which may be converted previously (or simultaneously) into its metal neutralized form.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(l-hexenes), poly(l-octenes), poly(l-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyl s, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content ≤0.03 wt %, and ≥90 wt % saturates, viscosity index 80-120); Group III (sulfur content ≤0.03 wt %, and ≥90 wt % saturates, viscosity index ≥120); Group IV (all polyalphaolefins (PAOs)); and Group V (all others not included in Groups I, II, III, or IV).

The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may also be an API Group III+ base oil, which term refers to a Group III+ base oil having a viscosity index greater than or equal to 130. Group III+ are known in the art and is described in "Lube Report", dated Feb. 26, 2014 in an article entitled "SK Sees Group III Shortfall", by Nancy DeMarco. The article may be obtained from http://www.aselube.com/media/11910/sk_sees_group_iii_shortfall.pdf.

The oil of lubricating viscosity may be an API Group IV oil, or mixtures thereof, i.e., a polyalphaolefin. The polyalphaolefin may be prepared by metallocene catalyzed processes or from a non-metallocene process.

The oil of lubricating viscosity comprises an API Group I, Group II, Group III, Group IV, Group V oil or mixtures thereof.

Often the oil of lubricating viscosity may be an API Group I, Group II, Group II+, Group III, Group IV oil or mixtures thereof. Alternatively the oil of lubricating viscosity may be often an API Group II, Group II+, Group III or Group IV oil or mixtures thereof. Alternatively the oil of lubricating viscosity may be often an API Group II, Group II+, Group III oil or mixtures thereof.

The amount of the oil of lubricating viscosity present may be typically the balance remaining after subtracting from 100 wt % the sum of the amount of the additive as described herein above, and the other performance additives.

The lubricating composition may be in the form of a concentrate and/or a fully formulated lubricant. If the lubricating composition of the disclosed technology is in the form of a concentrate (which may be combined with additional oil to form, in whole or in part, a finished lubricant), the ratio of the of components of the disclosed technology to the oil of lubricating viscosity and/or to diluent oil include the ranges of 1:99 to 99:1 by weight, or 80:20 to 10:90 by weight.

In one embodiment the lubricating composition is not an aqueous composition.

The lubricating composition comprising may have a kinematic viscosity of 2 cSt to 20 cSt at 100° C., as measured by ASTM D445-14. The lubricating composition is liquid, i.e., not a gel or semi-solid, at ambient temperatures (5-30° C.).

Other Performance Additives

A lubricating composition may be prepared by adding the aromatic compound described herein to an oil of lubricating viscosity, optionally in the presence of other performance additives (as described herein below).

The lubricating composition of the disclosed technology may further include other additives. In one embodiment the disclosed technology provides a lubricating composition further comprising at least one of a dispersant, an antiwear agent, a dispersant viscosity modifier, a friction modifier, a viscosity modifier, an antioxidant, an overbased detergent, a foam inhibitor, a demulsifier, a pour point depressant or mixtures thereof. In one embodiment the disclosed technology provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulfonates and phenates), or mixtures thereof.

The lubricating composition disclosed herein may further comprise an overbased detergent. The overbased detergent may be chosen from of non-sulfur containing phenates, sulfur containing phenates, sulfonates, salixarates, salicylates, and mixtures thereof. In one embodiment the overbased detergent may be chosen from of non-sulfur containing phenates, sulfur containing phenates, sulfonates and mixtures thereof.

Typically an overbased detergent may be sodium, calcium or magnesium (typically calcium) salt of the phenates, sulfur containing phenates, sulfonates, salixarates and salicylates. Overbased phenates and salicylates typically have a total base number of 180 to 450 TBN. Overbased sulfonates typically have a total base number of 250 to 600, or 300 to 500. Overbased detergents are known in the art. In one embodiment the sulfonate detergent may be a predominantly linear alkylbenzene sulfonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulfonate detergent may be particularly useful for assisting in improving fuel economy. In one embodiment, the sulfonate detergent may be a branched alkylbenzene sulfonate detergent. Branched alkylbenzene sulfonate may be prepared from isomerized alpha olefins, oligomers of low molecular weight olefins, or combinations thereof. Typical oligomers include tetramers, pentamers, and hexamers of propylene and butylene. In one embodiment the sulfonate detergent may be a metal salt of one or more oil-soluble alkyl toluene sulfonate compounds as disclosed in paragraphs [0046] to [0053] of US Patent Application 2008/0119378.

The overbased metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a hybrid sulfonate/phenate detergent may be employed, the hybrid detergent would be considered equivalent to amounts of distinct phenate and sulfonate detergents introducing like amounts of phenate and sulfonate soaps, respectively.

In one embodiment, the embodied salts of aromatic compounds described above may also be employed in the form of "hybrid" detergents with alternative conventional detergent substrates, such as sulfonate, phenate, salicylate, salixarates, saligenins and sulfuric acid substrates. Accordingly, in one embodiment, hybrid detergents may comprise a major portion of a salt of an aromatic compound described above and a minor portion (less than about 20 wt % with respect to the total weight of the substrate, or less than about 15 wt % or 10 wt % or 5 wt %) of a second substrate, which may be a sulfonate, phenate, salicylate, salixarates, saligenins and sulfuric acid substrates or mixture thereof.

Lubricating compositions may contain phenol-based detergents, i.e. detergents wherein the substrate includes or may be derived from phenol or alkylphenol. Detergents of this type include sulfur-coupled phenates, alkylene-coupled phenates, salicylates (i.e. carboxylated phenol), salixarates, and saligenins. These phenol-based detergents may be neutral or overbased.

In one embodiment the lubricating composition further comprises a non-sulfur containing phenate, or sulfur containing phenate, or mixtures thereof. The non-sulfur containing phenates and sulfur containing phenates and known in the art. The non-sulfur containing phenate, or sulfur containing phenate may be neutral or overbased. Typically an overbased non-sulfur containing phenate, or a sulfur containing phenate have a total base number of 180 to 450 TBN and a metal ratio of 2 to 15, or 3 to 10. A neutral non-sulfur containing phenate, or sulfur containing phenate may have a TBN of 80 to less than 180 and a metal ratio of 1 to less than 2, or 0.05 to less than 2.

The non-sulfur containing phenate, or sulfur containing phenate may be in the form of a calcium or magnesium non-sulfur containing phenate, or sulfur containing phenate (typically calcium non-sulfur containing phenate, or sulfur containing phenate). When present the non-sulfur containing phenate, or sulfur containing phenate may be present at 0.1 to 10 wt %, or 0.5 to 8 wt %, or 1 to 6 wt %, or 2.5 to 5.5 wt % of the lubricating composition.

In one embodiment the lubricating composition may be free of an overbased phenate, and in a different embodiment the lubricating composition may be free of a non-overbased phenate. In another embodiment the lubricating composition may be free of a phenate detergent.

Phenate detergents are typically derived from p-hydrocarbyl phenols. Alkylphenols of this type may be coupled with sulfur and overbased, coupled with aldehyde and overbased, or carboxylated to form salicylate detergents. Suitable alkylphenols include those alkylated with oligomers of propylene, i.e. tetrapropenylphenol (i.e. p-dodecylphenol or PDDP) and pentapropenylphenol. Suitable alkylphenols also include those alkylated with oligomers of butene, especially tetramers and pentamers of n-butenes. Other suitable alkylphenols include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent derived from PDDP. In one embodiment, the lubricant composition comprises a phenate detergent that is not derived from PDDP. In one embodiment, the lubricating composition comprises a phenate detergent prepared from PDDP wherein the phenate detergent contains less than 1.0 weight percent unreacted PDDP, or less than 0.5 weight percent unreacted PDDP, or substantially free of PDDP.

In one embodiment the lubricating composition further comprises a salicylate detergent that may be neutral or overbased. The salicylates and known in the art. The salicylate detergent may have a TBN of 50 to 400, or 150 to 350, and a metal ratio of 0.5 to 10, or 0.6 to 2. Suitable salicylate detergents included alkylated salicylic acid, or alkylsalicylic acid. Alkylsalicylic acid may be prepared by alkylation of salicylic acid or by carbonylation of alkylphenol. When alkylsalicylic acid may be prepared from alkylphenol, the alkylphenol may be selected in a similar manner as the phenates described above. In one embodiment, alkylsalicylate of the disclosed technology include those alkylated with oligomers of propylene, i.e. tetrapropenylphenol (i.e. p-dodecylphenol or PDDP) and pentapropenylphenol. Suitable alkylphenols also include those alkylated with oligomers of butane, especially tetramers and pentamers of n-butenes. Other suitable alkylphenols include those alkylated with alpha-olefins, isomerized alpha-olefins, and polyolefins like polyisobutylene. In one embodiment, the lubricating composition comprises a salicylate detergent prepared from PDDP wherein the phenate detergent contains less than 1.0 weight percent unreacted PDDP, or less than 0.5 weight percent unreacted PDDP, or substantially free of PDDP.

When present the salicylate may be present at 0.01 to 10 wt %, or 0.1 to 6 wt %, or 0.2 to 5 wt %, 0.5 to 4 wt %, or 1 to 3 wt % of the lubricating composition.

Overbased detergents are known in the art. Overbased materials, otherwise referred to as overbased or superbased salts, are generally single phase, homogeneous Newtonian systems characterised by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, typically carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) may be commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio" is also explained in standard textbook entitled "Chemistry and Technology of Lubricants", Third Edition, Edited by R. M. Mortier and S. T. Orszulik, Copyright 2010, page 219, sub-heading 7.25.

The overbased detergent may be present at 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition comprises at least one overbased detergent with a metal ratio of at least 3, or at least 8, or at least 15. In one embodiment, the overbased detergent may be present in an amount to deliver total base number (TBN) of at least 3 mg KOH/g to the lubricating composition or at least 4 mg KOH/g, or at least 5 mg KOH/g to the lubricating composition; the overbased detergent may deliver 3 to 10 mg KOH/g, or 5 to 10 mg KOH/g to the lubricating composition.

As referred to herein, the TBN may be measured using ASTM D2986-11.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the disclosed technology does include a dispersant or mixtures thereof. The dispersant may be present as a single dispersant. The dispersant may be present as a mixture of two or more (typically two or three) different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be chosen from of ethylenediamine, diethylenetriamine, triethylenetetramine, tetraethylenepentamine, pentaethylenehexamine, polyamine still bottoms, and mixtures thereof.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant may be derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from C2-C6 epoxides such as ethylene oxide, propylene oxide, and butylene oxide. Examples of polyether polyamines are sold under the Jeffamine® brand and are commercially available from Hunstman Corporation located in Houston, Tex.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide may be polyisobutylene succinimide. Typically the polyisobutylene from which polyisobutylene succinic anhydride may be derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant may be borated. In one embodiment the post-treated dispersant may be reacted with dimercaptothiadiazoles. In one embodiment the post-treated dispersant may be reacted with phosphoric or phosphorous acid. In one embodiment the post-treated dispersant may be reacted with terephthalic acid and boric acid (as described in US Patent Application US2009/0054278.

In one embodiment the dispersant may be borated or non-borated. Typically a borated dispersant may be a succinimide dispersant. In one embodiment, the ashless dispersant may be boron-containing, i.e., has incorporated boron and delivers said boron to the lubricant composition. The boron-containing dispersant may be present in an amount to deliver at least 25 ppm boron, at least 50 ppm boron, or at least 100 ppm boron to the lubricant composition. In one embodiment, the lubricant composition may be free of a boron-containing dispersant, i.e. delivers no more than 10 ppm boron to the final formulation.

Dispersants may be derived from, as the polyolefin, high vinylidene polyisobutylene, that is, having greater than 50, 70, or 75% terminal vinylidene groups (alpha and beta isomers). In certain embodiments, the succinimide dispersant may be prepared by the direct alkylation route. In other embodiments it may comprise a mixture of direct alkylation and chlorine-route dispersants. The dispersant may be prepared/obtained/obtainable from reaction of succinic anhydride by an "ene" or "thermal" reaction, by what is referred to as a "direct alkylation process". The "ene" reaction mechanism and general reaction conditions are summarised in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that may be a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6.

The dispersant may be present at 0 wt % to 20 wt %, 0.1 wt % to 15 wt %, or 0.5 wt % to 9 wt %, or 1 wt % to 8.5 wt % of the lubricating composition.

In one embodiment the lubricating composition may be a lubricating composition further comprising a molybdenum compound. The molybdenum compound may be an antiwear agent or an antioxidant. The molybdenum compound may be chosen from of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Antioxidants include sulfurised olefins, diarylamines, alkylated di arylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalised with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; 6,117,825; and 7,790,661. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment the dispersant viscosity modifier may include those described in U.S. Pat. No. 7,790,661 column 2, line 48 to column 10, line 38.

In one embodiment the lubricating composition of the disclosed technology further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

In one embodiment the friction modifier may be chosen from of long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartaric acid derivatives such as tartrate esters, amides or tartrimides, oil soluble amine salts of phosphorus compounds, sulfurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups may be at least 8. The antiwear agent may in one embodiment include a citrate as is disclosed in US Patent Application 2005/0198894.

The lubricating composition may further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound may be a titanium (IV) alkoxide. The titanium alkoxide may be formed from a monohydric alcohol, a polyol or mixtures thereof. The monohydric alkoxides may have 2 to 16, or 3 to 10 carbon atoms. In one embodiment, the titanium alkoxide may be titanium (IV) isopropoxide. In one embodiment, the titanium alkoxide may be titanium (IV) 2-ethylhexoxide. In one embodiment, the titanium compound comprises the alkoxide of a vicinal 1,2-diol or polyol.

In one embodiment, the 1,2-vicinal diol comprises a fatty acid mono-ester of glycerol, often the fatty acid may be oleic acid.

In one embodiment, the oil soluble titanium compound may be a titanium carboxylate. In one embodiment the titanium (IV) carboxylate may be titanium neodecanoate.

Foam inhibitors that may be useful in the compositions of the disclosed technology include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the disclosed technology include polyalphaolefins, esters of maleic anhydride-styrene copolymers, poly(meth) acrylates, polyacrylates or polyacrylamides.

Demulsifiers include trialkyl phosphates, and various polymers and copolymers of ethylene glycol, ethylene oxide, propylene oxide, or mixtures thereof different from the non-hydroxy terminated acylated polyalkylene oxide of the disclosed technology.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulpholene derivatives Exxon Necton-37™ (FN 1380) and Exxon Mineral Seal Oil™ (FN 3200).

An engine lubricating composition in different embodiments may have a composition as disclosed in the following table:

| | Embodiments (wt %) | | |
|---|---|---|---|
| Additive | A | B | C |
| Salt of an aromatic compound | 0.4 to 5 | 0.5 to 3 | 1 to 2 |
| Overbased Detergent | 2 to 9 | 3 to 8 | 3 to 5 |

-continued

| | Embodiments (wt %) | | |
|---|---|---|---|
| Additive | A | B | C |
| Dispersant Viscosity Modifier | 0 to 5 | 0 to 4 | 0.05 to 2 |
| Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

INDUSTRIAL APPLICATION

In one embodiment the disclosed technology provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an exhaust gas recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. Diesel fueled engines may be fueled with a mixture of conventional diesel fuel and bio-derived diesel fuel (i.e. bio-diesel). In one embodiment the diesel engine fuel may comprise 5 volume percent to 100 volume percent bio-diesel (i.e. B5 to b100); in one embodiment the diesel fuel comprises 5 volume percent to 50 volume percent bio-diesel or 8 volume percent to 30 volume percent bio-diesel. In one embodiment the diesel fuel is substantially free of (i.e. contains less than 1 volume percent) bio-diesel. In one embodiment the internal combustion engine may be a heavy duty diesel engine. In one embodiment, the internal combustion engine may be a gasoline direct injection (GDI) engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine). In one embodiment the internal combustion engine is a 4-stroke engine, and is a compression ignition engine or a positive ignition natural gas (NG) or LPG engine.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulfated ash content may be 0.3 wt % to 1.2 wt %, or 0.5 wt % to 1.2 wt % or 1.1 wt % of the lubricating composition. In one embodiment the sulfated ash content may be 0.5 wt % to 1.2 wt % of the lubricating composition. The TBN (as measured by ASTM D2896) of the engine oil lubricant may be 5 mg KOH/g to 15 mg KOH/g, or 6 mg KOH/g to 12 mg KOH/g, or 7 mg KOH/g to 10 mg KOH/g.

In one embodiment the lubricating composition may be an engine oil, wherein the lubricating composition may be characterised as having at least one of (i) a sulfur content of 0.5 wt % or less, (ii) a phosphorus content of 0.12 wt % or less, and (iii) a sulfated ash content of 0.5 wt % to 1.1 wt % of the lubricating composition.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this disclosed technology, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

The following examples provide illustrations of the disclosed technology. These examples are non-exhaustive and are not intended to limit the scope of the disclosed technology.

EXAMPLES

All reactants and additives are expressed on an oil-free basis unless otherwise noted.

Preparative Example 1 (EX1); 2-((2-hydroxyhexadecyl)oxy)phenol

A 2 L 4-neck round bottom flask, equipped with a Dean Stark apparatus and a nitrogen blanket (0.5 cfh), is charged with pyrocatechol (165 g), sodium hydroxide (6.20 g), and toluene (400 mL) while stirring. The reaction mixture is heated to 80° C. and 2-tetradecyloxirane (359.9 g) is added over 1 hour; the mixture is then heated at reflux for 3 hours. The reaction mixture is cooled to 95° C. and then quenched with aqueous hydrochloric acid (10%, 200 mL). The reaction mixture is allowed to cool to ambient temperature while standing and the reaction product separates from the mixture as a solid. The solid is separated from the liquid, washed to remove water, and dried under vacuum to give a tan solid (313 g).

Preparative Example 2; Neutral Calcium Salt of 2-((2-hydroxyhexadecyl)oxy)phenol A 1 L round bottom flask, equipped with Dean-Stark and a nitrogen blanket, is charged with 2-((2-hydroxyhexadecyl)oxy)phenol (150.6 g), toluene (200 mL) and diluent oil (48.4 g); the mixture is heated to 68° C. while stirring. Methanol (20 g) is added slowly, followed by hydrated lime (21.3 g); the reaction mixture increased in temperature to 74° C. The reaction mixture is heated at reflux for 2 hours (74° C.). The reaction mixture is stripped to removed solvents at 130° C. and filtered through filter aid (20 g) to give a brown liquid (200 g; Calcium 3.42 wt %; TBN=139 mg KOH/g)

Preparative Example 3; Neutral Calcium Salt of 2-((2-hydroxyhexadecyl)oxy)phenol A 1 L round bottom flask, equipped with a condenser, thermocouple, addition funnel and blanket, is charged with pyrocatechol (100 g). The catechol is heated to 100° C. Potassium hydroxide (2.52 g) is added in multiple portions resulting in an exotherm of up to 135° C. The resulting red solution is heated to 155° C. and 2-tetradecyloxirane (240 g) is added over 30 minutes; temperature is observed to increase to 165° C. The reaction mixture is maintained at 155° C. for 4 hours; after which, it is cooled to 100° C. and toluene (100 mL) and water (100 mL) are added. The water is drained from the reaction vessel, and the vessel is fitted with a dean-stark trap. The mixture is then heated (110° C.) to remove water. After cooling to 45° C., methanol (70 mL) and diluent oil (236.4 g) are added. Hydrated lime (67.2 g) is added in portions and the resulting mixture is heated to 70° C. for 2 hours, then to 115° C. to remove methanol, water and toluene. The reaction is cooled to room temperature and filtered to give a dark brown oil (591 g; 3.2 wt % calcium; TBN 89 mg KOH/g).

Preparative Example 4; Overbased Calcium Salt of 2-((2-hydroxyhexadecyl)oxy) phenol A 1 L round bottom flask, equipped with Frederick's condenser, overhead stirring, subsurface inlet, and thermowell, is charged with 2-((2-hydroxyhexadecyl)oxy)phenol (100.4 g), toluene (200 mL), and methanol (20 mL); the mixture is heated to 55° C. Hydrated lime (21.5 g) is added to the reaction mixture under vigorous stirring and a nitrogen sparge (0.5 cfh). The reaction mixture is heated to reflux at 65° C. for 20 min. Additional hydrated lime (41.6 g) is added and subsurface addition of carbon dioxide is initiated (0.3 cfh). After 100 minutes carbonation is stopped, and the reaction mixture is stripped under nitrogen at 130° C. The reaction mixture is cooled below 100° C.; diluent oil is added (88.2 g); and the product mixture is filtered to give a brown oil (151 g; 9.85 wt % Ca; TBN 277 mg KOH/g).

Preparative Example 5; Alkylated Pyrocatechol

A 3 L round bottom flask, equipped with an overhead stirrer, reflux condenser and addition funnel, is charged with toluene (1 L) and pyrocatechol (500 g). The temperature is raised to 110° C., after which Amberlyst® 15 (100 g) is added in one batch. A mixture of dodecene (254.8 g) and toluene (100 mL) are added dropwise via the additional funnel over the course of 1 hour. The reaction mixture is maintained at 110° C. for 4 hours, cooled to room temperature, filtered, and dried in vacuo to remove toluene and unreacted olefin.

Preparative Example 6; Overbased Calcium Salt of Alkylated Pyrocatechol

A 1 L round bottom flask, equipped with overheard stirring, subsurface gas inlet, and Friedrichs condenser, is charged with the alkylated pyrocatechol of Example 5 (101.7 g) decyl (35 g) alcohol, ethylene glycol 28 g), and diluent oil (123 g). The reaction mixture is heated to 98° C. and hydrated lime (48 g) is added. The reaction mixture is then heated to 166° C.; at which time subsurface sparging of carbon dioxide (0.3 cfh) is initiated. After 1 hour, the rate of $CO_2$ flow is increased to 0.5 cfh for 15 minutes. The reaction mixture is stripped under vacuum and the temperature is increased to 220° C. for 30 min. The reaction mixture is filtered neat over filter aid to give the product as a dark brown oil (184 g; Calcium 8.16 wt %; TBN 231 mg KOH/g)

Preparative Example 17; Borated Calcium Salt of Oxyalkylated Catechol

A 2 L round bottom flask, equipped with a condenser, overhead stirring, and subsurface inlet, is charged with 2-((2-hydroxyhexadecyl)oxy)phenol (300 g), toluene (400 g), and methanol (22 g); the mixture is heated to 55° C. Hydrated lime (40 g) is added to the reaction mixture under vigorous stirring and a nitrogen sparge (0.5 cfh). The reaction mixture is heated to reflux at 65° C. for 20 min. Additional hydrated lime (70 g) is added and subsurface addition of carbon dioxide is initiated (0.4 cfh). After 120 minutes carbonation is stopped, and the reaction mixture is stripped under nitrogen at 125° C. The reaction mixture is cooled below 100° C.; diluent oil is added (177 g); and the product mixture is filtered to give a brown oil (9.52% wt calcium; TBN 268.5 mg KOH/g). A 500 mL round bottom flask is charged with the overbased calcium salt (100.9 g) and warmed to 70° C. under nitrogen while stirring. Boric acid (22 g) is added over 5 minutes and the reaction temperature is increased to 110° C. The reaction mixture is held at 110° C. for 1.5 hours. Toluene (300 mL) is added to the reaction mixture and held at temperature for an additional 30 minutes. The reaction mixture is stripped under vacuum at 140° C. and filtered to yield a brown oil (7.48% wt calcium; 2.54% wt boron; TBN 217 mg KOH/g).

Preparative Example 18; Preparation of Borated Oxyalkylated Catechol and Overbased Calcium Sulfonate Detergent Blend A 1 L round bottom flask, equipped with a condenser, bent hook stirrer, and immersed thermocouple, is charged with C12/C14 glycidyl ether catechol (200.1 g), and toluene (254.2 g); the mixture is heated to 60° C. under vigorous stirring and a nitrogen sparge (0.5 cfh). The mixture is further heated to 65° C. and boric acid (33.3 g) is added to the reaction mixture. The reaction mixture is heated to reflux at 65° C. for 3.5 hours during which time 15.5 g of water is isolated. The reaction mixture is cooled to 60 C and methanol (4.7 mL) is added. The mixture is warmed to 70° C. and 201.1 g of a 400 TBN overbased calcium sulfonate detergent is added and the mixture heated at 70° C. for 3 hours. The product mixture is filtered and the toluene is stripped to yield 388.3 g of material (7.08% wt calcium; 1.23% wt boron; TBN 197 mg KOH/g)

Other examples are prepared in analogous fashion as described above. All inventive examples are summarized in Table 1.

TABLE 1

| Inventive Examples | | | | | | | |
|---|---|---|---|---|---|---|---|
| EX | Aromatic Polyol[1] | Alkylate[2] | Oxyalkylate[3] | Calcium (wt %) | TBN (mg KOH/g) | Metal Ratio | Oil (%) |
| 2 | cat | none | 2-hydroxyhexadecyl | n.m. | 139 | 1.1 | 18.5 |
| 3 | cat | none | 2-hydroxyhexadecyl | 3.2 | 89 | 1.0 | 40 |
| 4 | cat | none | 2-hydroxyhexadecyl | 9.85 | 277 | 2.8 | 34 |
| 6 | cat | $1 \times C_{12}$ | none | 8.16 | 231 | 2.0 | 40 |
| 7 | cat | $2 \times C_{12}$ | none | 2.76 | 79.2 | 0.8 | 18 |
| 8 | cat | none | 2-hydroxyhexadecyl | 5.53 | 153 | 1.4 | 28 |
| 9 | cat | $1 \times C_{12}$ | none | 5.74 | 159 | 1.1 | 20 |
| 10 | cat | $1 \times C_{12}$ | none | 5.03 | 166 | 1.2 | 40 |
| 11 | cat | $1 \times C_{16\text{-}18}$ | none | 5.62 | 131 | 1.0 | 37 |
| 12 | cat | $PIB_{322}$ | none | 3.15 | 89 | 0.9 | 20.2 |
| 13 | cat | $PIB_{550}$ | none | 1.33 | 38 | 0.85 | 50 |
| 14 | cat | $PIB_{750}$ | none | 1.6 | 44 | 0.9 | 20 |
| 15 | cat | $1 \times C_{12}$ | 2-hydroxybutyl | 3.94 | 111 | 1.2 | 40 |
| 16 | cat | $1 \times C_{20\text{-}24}$ | 2-hydroxybutyl | 2.86 | 84 | 1.2 | 40 |
| 17[4] | cat | none | 2-hydroxyhexadecyl | 7.48 | 217 | 2.0 | 29 |
| 18 | cat | $1 \times C_{12}$ | 2-hydroxyhexadecyl | 2.36 | 65 | 1.1 | 40 |
| 19 | cat | none | 2-hydroxyhexadecyl | 10.42 | 295 | 3.0 | 34 |
| 20 | cat | $2 \times C_{12}$ | none | 7.97 | 220 | 2.5 | 26 |
| 21 | cat | $1 \times C_{20\text{-}24}$ | none | 11.12 | 312 | 4.7 | 47.8 |
| 22 | gall | none | 2-hydroxyhexadecyl | 3.73[5] | 105[5] | 1.2[5] | 40[5] |

TABLE 1-continued

| Inventive Examples | | | | | | | |
|---|---|---|---|---|---|---|---|
| EX | Aromatic Polyol[1] | Alkylate[2] | Oxyalkylate[3] | Calcium (wt %) | TBN (mg KOH/g) | Metal Ratio | Oil (%) |
| 23 | gall | 1 × $C_{12}$ | none | 4.42[5] | 130[5] | 1.1[5] | 35[5] |
| 24 | nap23 | none | 2-hydroxyhexadecyl | 3.06[5] | 87[5] | 1.0[5] | 37[5] |
| 25 | nap23 | 1 × $C_{12}$ | none | 3.64[5] | 103[5] | 1.1[5] | 40[5] |

[1]Aromatic polyol refers to the starting polyol from which the metal salt is prepared: cat = catechol, gall = 1,2,3-trihydroxybenzene (i.e. pyrogallol), nap23 = naphthalene-2,3-diol
[2]Alkylate refers to hydrocarbyl groups attached directly to the aromatic ring: 1 × $C_{12}$ refers to 1 alkyl group containing 12 carbon atoms, 2 × $C_{12}$ refers to 2 alkyl groups containing 12 carbon atoms, $PIB_{322}$ refers to a polyisobutylene alkylate with Mn = 322, etc.
[3]Oxyalkylate groups are hydrocarbyl, hydroxy-substituted hydrocarbyl, or polyether groups attached to the oxygen atom of the aromatic polyol.
[4]Borated salt, 2.54% by weight boron
[5]Calculated A series of 15W-40 heavy duty diesel engine lubricants in Group II base oil of lubricating viscosity are prepared containing the additives described above as well as conventional additives including polymeric viscosity modifier, ashless succinimide dispersant, overbased detergents different from that of the disclosed technology, antioxidants (combination of phenolic ester, diarylamine, and sulfurized olefin), zinc dialkyldithiophosphate (ZDDP), as well as other performance additives as follows (Table 2):

A series of 5W-30 passenger car engine lubricants in Group III base oil of lubricating viscosity are prepared containing the additives described above as well as conventional additives including polymeric viscosity modifier, ashless succinimide dispersant, overbased detergents different from that of the disclosed technology, antioxidants (combination of phenolic ester, diarylamine, and sulfurized olefin), zinc dialkyldithiophosphate (ZDDP), as well as other performance additives as follows (Table 3):

TABLE 2

| Heavy Duty Diesel Lubricating Compositions[1] | | | | | | | | |
|---|---|---|---|---|---|---|---|---|
| | LEX1 | LEX2 | LEX3 | LEX4 | LEX5 | LEX6 | LEX7 | LEX8 |
| Group II Base Oil | | | | Balance to 100% | | | | |
| EX1 | | | 0.60 | | | | | |
| EX7 | | | | 0.76 | | | | |
| EX10 | | | | | 1.06 | | | |
| EX11 | | | | | | 1.00 | | |
| EX15 | | | | | | | 1.05 | |
| EX19 | | | | | | | | 0.87 |
| Ca phenate[2] | 0.67 | 0 | 0 | 0 | 0 | 0 | 0 | 0 |
| Ca phenate[3] | 0.55 | 0 | 0 | 0 | 0 | 0 | 0 | 0 |
| Ca sulfonate[4] (104.40) | 0.92 | 0.92 | 0.92 | 0.92 | 0.92 | 0.92 | 0.92 | 0.92 |
| Ca sulfonate[5] (106.75) | 0.69 | 0.69 | 0.69 | 0.69 | 0.69 | 0.69 | 0.69 | 0.69 |
| Dispersant[6] | 8.2 | 8.2 | 8.2 | 8.2 | 8.2 | 8.2 | 8.2 | 8.2 |
| Secondary ZDDP | 1.09 | 1.09 | 1.09 | 1.09 | 1.09 | 1.09 | 1.09 | 1.09 |
| Ashless Antioxidant[7] | 1.23 | 1.23 | 1.23 | 1.23 | 1.23 | 1.23 | 1.23 | 1.23 |
| Soot dispersant[8] | 0.67 | 0.67 | 0.67 | 0.67 | 0.67 | 0.67 | 0.67 | 0.67 |
| Polymeric VI Improver | 0.56 | 0.56 | 0.56 | 0.56 | 0.56 | 0.56 | 0.56 | 0.56 |
| Other Additives | 0.33 | 0.33 | 0.33 | 0.33 | 0.33 | 0.33 | 0.33 | 0.33 |
| % Phosphorus | 0.106 | 0.113 | 0.110 | 0.110 | 0.110 | 0.112 | 0.114 | 0.110 |
| % Calcium | 0.240 | 0.142 | 0.146 | 0.158 | 0.190 | 0.188 | 0.181 | 0.230 |
| % Sulfur | 0.399 | 0.312 | 0.320 | 0.315 | 0.307 | 0.318 | 0.319 | 0.313 |
| TBN (ASTM D2896) | 8.2 | 5.7 | 5.6 | 6.2 | 7.1 | 7.0 | 6.9 | 8.5 |
| % Sulfated Ash | 0.96 | 0.74 | 0.69 | 0.81 | 0.81 | nm | 0.81 | 0.97 |

[1]Additive treat rates are on an oil free basis, unless otherwise noted; all preparative examples contain oil as described in Table 1
[2]Overbased calcium sulfur-coupled phenate; 255 TBN; 39% oil
[3]Neutral sulfur-coupled phenate; 145 TBN; 27% oil
[4]Overbased calcium alkylbenzene sulfonate; 300 TBN; 42% oil
[5]Overbased calcium alkylbenzene sulfonate; 85 TBN; 47% oil
[6]Succinimide prepared from polyisobutylene (2200 Mn); 28 TBN; 50% oil
[7]Combination of hindered phenol, alkylated diarylamine, and sulfurized olefin
[8]Ethylene/propylene copolymer functionalized with aromatic amine; Mn 9000
[9]Other additives include corrosion inhibitors, foam inhibitors, and pourpoint depressants

TABLE 3

| | Lubricating Compositions[1] | | | | | | | | |
|---|---|---|---|---|---|---|---|---|---|
| | LEX9 | LEX10 | LEX11 | LEX12 | LEX13 | LEX14 | LEX15 | LEX16 | LEX17 |
| Group II Base Oil | Balance to 100% | | | | | | | | |
| EX1 | | 1.26 | | | | | | | |
| EX2 | | | 1.67 | | | | | | |
| EX3 | | | | 2.34 | | | | | |
| EX8 | | | | | 1.97 | | | | |
| EX9 | | | | | | 1.68 | | | |
| EX11 | | | | | | | 2.10 | | |
| EX12 | | | | | | | | 1.63 | |
| EX19 | | | | | 0.095 | | | | |
| EX20 | | | | | | | | | 2.0 |
| Ca phenate[2] | 0.1 | 0 | 0 | 0 | 0 | 0 | 0 | 0 | 0 |
| Ca phenate[3] | 1.9 | 0 | 0 | 0 | 0 | 0 | 0 | 0 | 0 |
| Ca Sulfonate[4] | 0.1 | 0.1 | 0.1 | 0.1 | 0.1 | 0.1 | 0.1 | 0.1 | 0.1 |
| Dispersant[5] | 7 | 7 | 7 | 7 | 7 | 7 | 7 | 7 | 7 |
| Secondary ZDDP | 0.45 | 0.45 | 0.45 | 0.45 | 0.45 | 0.45 | 0.45 | 0.45 | 0.45 |
| Ashless AO[6] | 2.8 | 2.8 | 2.8 | 2.8 | 2.8 | 2.8 | 2.8 | 2.8 | 2.8 |
| VI Improver[7] | 1.27 | 1.27 | 1.27 | 1.27 | 1.27 | 1.27 | 1.27 | 1.27 | 1.27 |
| Other Additives | 0.76 | 0.76 | 0.76 | 0.76 | 0.76 | 0.76 | 0.76 | 0.76 | 0.76 |
| % Phosphorus | 0.046 | 0.045 | 0.045 | 0.044 | 0.042 | 0.048 | 0.047 | 0.048 | 0.046 |
| % Calcium | 0.128 | 0.016 | 0.098 | 0.0891 | 0.130 | 0.110 | 0.110 | 0.072 | 0.181 |
| % Sulfur | 0.180 | 0.095 | 0.098 | 0.092 | 0.0909 | 0.101 | 0.095 | 0.102 | 0.101 |
| % Titanium | 0.0045 | 0.0044 | 0.0042 | 0.0043 | 0.0043 | 0.0041 | 0.0042 | 0.0044 | 0.0044 |
| % Sulfated Ash | 0.51 | 0.21 | 0.44 | 0.39 | 0.54 | 0.49 | 0.45 | 0.36 | |

[1]Additive treat rates are on an oil free basis, unless otherwise noted; all preparative examples contain oil as described in Table 1

[2]Overbased calcium sulfur-coupled phenate; 255 TBN; 39% oil

[3]Neutral sulfur-coupled phenate; 145 TBN; 27% oil

[4]Overbased calcium alkylbenzene sulfonate; 400 TBN; 42% oil

[5]Succinimide prepared from high vinylidene polyisobutylene (2000 Mn); 12 TBN; 29% oil

[6]Combination of hindered phenol, alkylated diarylamine, and sulfurized olefin

[7]Styrene-butadiene block copolymer

[8]Other additives include friction modifiers, corrosion inhibitors, pourpoint depressant, and foam inhibitors The lubricants may be evaluated for cleanliness, i.e. the ability to prevent or reduce deposit formation; sludge handling; soot handling; antioxidancy; and wear reduction.

Oxidation control is evaluated utilizing pressure differential scanning calorimtery (PDSC) which determines oxidation induction time (OIT) for lubricating compositions. This is a standard test procedure in the lubricating oil industry, based on CEC L-85 T-99. In this testing the lubricating composition is heated to an elevated temperature, typically about 25° C. below the average decomposition temperature for the sample being tested (in this case 215° C. at 690 kPa), and the time to when the composition begins to decompose is measured. The longer the test time, reported in minutes, the better the oxidative stability of the composition and the additives present within it.

Deposit control is measured by the Komatsu Hot Tube (KHT) test, which employs heated glass tubes through which sample lubricant is pumped, approximately 5 mL total sample, typically at 0.31 mL/hour for an extended period of time, such as 16 hours, with an air flow of 10 mL/minute. The glass tube is rated at the end of test for deposits on a scale of 0 (very heavy varnish) to 10 (no varnish). Deposit control is also evaluated in the TEOST 33C bench test (according to ASTM D6335).

In the Panel Coker deposit test, the sample, at 105° C., is splashed for 4 hours on an aluminum panel maintained at 325° C. The aluminum plates are analyzed using image analysis techniques to obtain a universal rating. The rating score is based on "100" being a clean plate and "0" being a plate wholly covered in deposit.

Anti-wear performance is measured in a programmed temperature high frequency reciprocating rig (HFRR) available from PCS Instruments. HFRR conditions for the evaluations are 200 g load, 75 minute duration, 1000 micrometer stroke, 20 hertz frequency, and temperature profile of 15 minutes at 40° C. followed by an increase in temperature to 160 C at a rate of 2° C. per minute. Wear scar in micrometers and film formation as percent film thickness are then measured with lower wear scar values and higher film formation values indicating improved wear performance.

Performance testing for both passenger car formulations and heavy duty diesel formulations is summarized below (Table 5).

TABLE 5

| Oxidation and deposit Test Results | | | | | | | |
|---|---|---|---|---|---|---|---|
| | L-85-99 | TEOST 33C (D6335) | | | PDSC | | Panel |
| | Oxidation Induction time (min) | Rod Deposits (mg) | Filter Deposits (mg) | Total Deposits (mg) | Onset Time (min) | KHT Tube Rating | Coker Universal Rating |
| LEX1 | 102.6 | 17.1 | 2.0 | 19.1 | 62.9 | 2 | 56 |
| LEX2 | 74.4 | 5 | 3.3 | 8.3 | 43.5 | 3 | 35 |
| LEX3 | 93.2 | 12.8 | 5.9 | 18.7 | nm | 3 | 59 |
| LEX4 | 88.7 | 7.5 | 0.4 | 7.9 | 54.3 | 2 | 22 |
| LEX5 | 84.8 | 8.1 | 10.7 | 18.8 | 49.3 | 3 | 43 |
| LEX6 | 87.7 | 11.9 | 4.7 | 16.6 | Nm | 2 | 29 |
| LEX7 | 91.8 | 14.8 | 2.9 | 17.7 | 49.2 | 2 | 29 |
| LEX8 | 81.3 | 17.9 | 2.9 | 20.8 | 50.8 | 1 | 21 |
| LEX9 | 206.7 | 6.7 | 15.5 | 22.2 | 106.5 | 1 | 92 |
| LEX10 | 102.4 | nm | nm | nm | nm | 6 | 60 |
| LEX11 | 222.8 | 15.4 | 12.4 | 27.8 | 100.2 | 8 | 88 |
| LEX12 | 203.3 | 7.2 | 11.7 | 18.9 | 99.6 | 8 | 77 |
| LEX13 | 294.7 | 20.2 | 87.7 | 107.9 | 103.6 | 8.5 | 72 |
| LEX14 | 207.5 | 5.7 | 13.9 | 19.6 | 115.8 | 8.5 | 60 |
| LEX15 | 141 | 6.3 | 17 | 23.3 | nm | 7.5 | 83 |
| LEX16 | 117 | 7.4 | 9.2 | 16.6 | 104.3 | 8 | 72 |
| LEX17 | 219.7 | 2.8 | 11.4 | 14.2 | nm | 7 | 72 |

nm = not measured

The data presented above indicates that the disclosed technology is capable of providing a lubricating composition with at least one of appropriate oil solubility, providing anti-wear performance, providing oxidation performance, viscosity performance, and detergency. In one embodiment the disclosed technology may also provide at least one effect demonstrated herein in a lubricating composition that may be free from or substantially free from C12 alkyl phenol moieties.

It is known that some of the materials described above may interact in the final formulation, so that the components of the final formulation may be different from those that are initially added. The products formed thereby, including the products formed upon employing lubricant composition of the present disclosed technology in its intended use, may not be susceptible of easy description. Nevertheless, all such modifications and reaction products are included within the scope of the present disclosed technology; the present disclosed technology encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the disclosed technology may be used together with ranges or amounts for any of the other elements.

While the disclosed technology has been explained in relation to its preferred embodiments, it is to be understood that various modifications thereof will become apparent to those skilled in the art upon reading the specification. Therefore, it is to be understood that the disclosed technology disclosed herein is intended to cover such modifications as fall within the scope of the appended claims.

What is claimed is:

1. A lubricating composition comprising:

an oil of lubricating viscosity; and 0.2 wt % to 10 wt % of an oil soluble salt of a hydroxyl functional aromatic compound, wherein the salt comprises:

(a) a conjugate anion of a hydroxyl functional aromatic compound, the aromatic compound selected from a neutral salt having a TBN of 130 to 200 mg KOH/g as determined by ASTM D2986-11 with a metal ratio of 0.7 to less than 2 or an overbased salt having a TBN of greater than 200 mg KOH/g as determined by ASTM D2986-11 with a metal ratio of 2 to 5, the aromatic compound being further represented by formula:

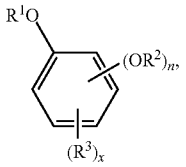

wherein n is 1 or 2, $R^1$ or $R^2$ are each independently hydrogen, a hydrocarbyl group containing 1 to 32 carbon atoms, or $—(CH_2CHR^4—O—)_mR^5$;

$R^3$ is hydrogen, a hydrocarbyl group containing 1 to 150 carbon atoms or a hydrocarbyl group containing 6 to 36 carbon atoms, or an acyl group, $—C(=O)OR^6$, or $—(CH_2CHR^4—O—)_mR^5$;

$R^4$ is hydrogen or a hydrocarbyl group containing 1 to 32 carbon atoms, or $CH_2OR^8$;

$R^5$ is hydrogen or a hydrocarbyl group containing 1 to 24 carbon atoms, or $—(C=O)R^7$;

$R^6$ is a hydrocarbyl group containing 1 to 24 carbon atoms, or $—(CH_2CHR^4—O—)_mR^5$;

$R^7$ may be a hydrocarbyl group containing 1 to 24 carbon atoms;

$R^8$ may be hydrogen or a hydrocarbyl group containing 1 to 24 carbon atoms;

m=1 to 20;

x is 0 to 2 and each $R^3$ is independently a hydrocarbyl group containing at least one carbon atom where together the $R^3$ moieties form a 5- or 6-membered saturated, partially unsaturated or unsaturated hydrocarbyl ring, with the proviso that at least one of $R^1$, $R^2$ or $R^3$ is not hydrogen and at least one of $R^1$, $R^2$ or $R^5$ is a hydrogen; and (b) a cation having an atomic weight of at least 10.

2. The lubricating composition of claim 1, wherein cation is a metallic cation and the metal of the metallic cation is selected from calcium, barium or magnesium, or an alkali metal such as sodium, or potassium.

3. The lubricating composition of claim 1, wherein x is 1 or 2, and each R3 is a hydrocarbyl group containing 1 to 150 carbon atoms or a hydrocarbyl group containing 6 to 36 carbon atoms.

4. The lubricating composition of claim 1, wherein x is 1, and $R^1$ is $—(CH_2CHR^4—O—)_mR^5$ $R^4$ is a hydrocarbyl group containing 1 to 4 carbon atoms, $R^5$ is hydrogen or a hydrocarbyl group containing 1 to 24 carbon atoms, and m=1 to 20, or 5 to 18.

5. The lubricating composition of claim 1, wherein the aromatic compound forming the salt is represented by the formula:

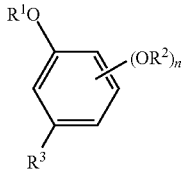

wherein n is 1 or 2, $R^1$ is hydrogen, a hydrocarbyl group containing 1 to 32 carbon atoms, or $—(CH_2CHR^4—O—)_mR^5$, $R^2$ is hydrogen, $R^3$ is hydrogen or a hydrocarbyl group containing 1 to 150 carbon atoms or a hydrocarbyl group containing 6 to 36 carbon atoms, $R^4$ is hydrogen or a hydrocarbyl group containing 1 to 32 carbon atoms, or $CH_2OR^8$, $R^5$ is hydrogen or a hydrocarbyl group containing 1 to 24 carbon atoms, or $—(C═O)R^7$, $R^7$ may be a hydrocarbyl group containing 1 to 24 carbon atoms, $R^8$ may be hydrogen or a hydrocarbyl group containing 1 to 24 carbon atoms, and m=1 to 20 with the proviso that at least one of $R^1$ or $R^3$ is not hydrogen.

6. The lubricating composition of claim 1, wherein the aromatic compound forming the salt is represented by the formula:

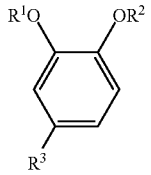

wherein $R^1$ is hydrogen, a hydrocarbyl group containing 1 to 32 carbon atoms, or $—(CH_2CHR^4—O—)_mR^5$, $R^2$ is hydrogen, $R^3$ is hydrogen or a hydrocarbyl group containing 1 to 150 carbon atoms or a hydrocarbyl group containing 6 to 36 carbon atoms, $R^4$ is hydrogen or a hydrocarbyl group containing 1 to 32 carbon atoms, or $CH_2OR^8$, $R^5$ is hydrogen or a hydrocarbyl group containing 1 to 24 carbon atoms, or $—(C═O)R^7$, $R^7$ may be a hydrocarbyl group containing 1 to 24 carbon atoms, $R^8$ may be hydrogen or a hydrocarbyl group containing 1 to 24 carbon atoms, and m=1 to 20 with the proviso that at least one of $R^1$ or $R^3$ is not hydrogen.

7. The lubricating composition of claim 1, wherein the aromatic compound forming the salt is represented by the formula:

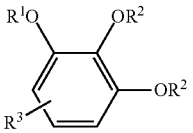

$R^1$ is hydrogen, each $R^2$ independently is hydrogen, a hydrocarbyl group containing 1 to 32 carbon atoms, or $—(CH_2CHR^4—O—)_mR^5$, $R^3$ is hydrogen, a hydrocarbyl group containing 1 to 150 carbon atoms or a hydrocarbyl group containing 6 to 36 carbon atoms, or an acyl group $C(═O)XR^6$ $R^4$ is hydrogen or a hydrocarbyl group containing 1 to 32 carbon atoms, or $CH_2OR^8$, $R^5$ is hydrogen or a hydrocarbyl group containing 1 to 24 carbon atoms, or $—(C═O)R^7$, and $R^6$ is a hydrocarbyl group containing 1 to 24 carbon atoms or $—(CH_2CHR^4—O—)_mR^5$, $R^7$ may be a hydrocarbyl group containing 1 to 24 carbon atoms, $R^8$ may be hydrogen or a hydrocarbyl group containing 1 to 24 carbon atoms, X is —O—, $—NR^9—$, $R^9$ is hydrogen or a hydrocarbyl group containing 1 to 24 carbon atoms, and m=1 to 20, with the proviso that at least one of $R^2$ or $R^3$ is not hydrogen.

8. The lubricating composition of claim 7, wherein the aromatic compound forming the salt is represented by the formula:

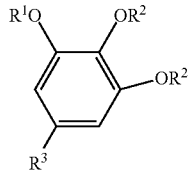

$R^1$ is hydrogen, a hydrocarbyl group containing 1 to 32 carbon atoms, or $—(CH_2CHR^4—O—)_mR^5$, $R^2$ is hydrogen, $R^3$ is hydrogen or a hydrocarbyl group containing 1 to 150 carbon atoms or a hydrocarbyl group containing 6 to 36 carbon atoms, $R^4$ is hydrogen or a hydrocarbyl group containing 1 to 32 carbon atoms, or $CH_2OR^8$, $R^5$ is hydrogen or a hydrocarbyl group containing 1 to 24 carbon atoms, or $—(C═O)R^7$, $R^7$ may be a hydrocarbyl group containing 1 to 24 carbon atoms, $R^8$ may be hydrogen or a hydrocarbyl group containing 1 to 24 carbon atoms, and m=1 to 20, with the proviso that at least one of $R^1$ or $R^3$ is not hydrogen.

9. The lubricating composition of claim 3, wherein $R^3$ is hydrogen.

10. The lubricating composition of claim 1, wherein the aromatic compound forming the salt comprises two or more edge-sharing rings is represented by the formulae:

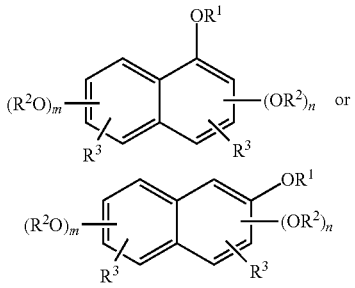

where $R^1$ is hydrogen, each $R^2$ independently is hydrogen, a hydrocarbyl group containing 1 to 32 carbon atoms, or $—(CH_2CHR^4—O—)_mR^5$, each $R^3$ independently is hydrogen, a hydrocarbyl group containing 1 to 150 carbon atoms or a hydrocarbyl group containing 6 to 36 carbon atoms, or an acyl group $—C(═O)OR^6$ $R^4$ is hydrogen or a hydrocarbyl group containing 1 to 32 carbon atoms, or $CH_2OR^8$, $R^5$ is hydrogen or a hydrocarbyl group containing 1 to 24 carbon atoms, or $—(C═O)R^7$, and $R^6$ is a hydrocarbyl group containing 1 to 24 carbon atoms, $R^7$ may be a hydrocarbyl group containing 1 to 24 carbon atoms, $R^8$ may be hydrogen or a hydrocarbyl group containing 1 to 24 carbon atoms, and m is 0, 1 or 2, n is 0, 1, or 2, such that m+n=1 or more, with the proviso that at least one of $R^2$ or $R^3$ is not hydrogen.

11. The lubricating composition of claim 1, wherein the aromatic compound forming the salt is represented by the formula:

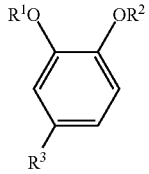

wherein $R^1$ is $—(CH_2CHR^4—O—)_mR^5$, $R^2$ is $—(CH_2CHR^4—O—)_mR^5$, $R^3$ is hydrogen or a hydrocarbyl group containing 1 to 150 carbon atoms or a hydrocarbyl group containing 6 to 36 carbon atoms, $R^4$ is hydrogen or a hydrocarbyl group containing 1 to 32 carbon atoms, or $CH_2OR^8$, $R^5$ is hydrogen or a hydrocarbyl group containing 1 to 24 or $—(C═O)R^7$, $R^7$ may be a hydrocarbyl group containing 1 to 24 carbon atoms, $R^8$ may be hydrogen or a hydrocarbyl group containing 1 to 24 carbon atoms, and m=1 to 20, with the proviso that at least one of $R^5$ or $R^8$ is hydrogen.

12. The lubricating composition of claim 1, wherein the salt of an aromatic compound does not contain (i) sulfonate functional group, or (ii) sulfur.

13. The lubricating composition of claim 1, wherein the salt of an aromatic compound does not contain phosphate functional group.

14. The lubricating composition of claim 1, wherein the salt of an aromatic compound does not contain borate functional group.

15. The lubricating composition of claim 1, wherein the salt of an aromatic compound is formed from an anion composed of carbon, hydrogen, and oxygen; and a metallic cation (typically calcium, magnesium or sodium, often calcium).

16. The lubricating composition of claim 1, wherein the oil of lubricating viscosity is selected from an API Group I, II, III, IV, V, or mixtures thereof base oil.

17. The lubricating composition of claim 1, wherein the lubricating composition has a SAE viscosity grade of XW—Y, wherein X may be 0, 5, 10, or 15; and Y may be 16, 20, 30, or 40.

18. The lubricating composition of claim 1, wherein the oil soluble salt is present in an amount ranging from 0.3 to 8 wt % of the lubricating composition.

19. The composition of claim 1, wherein the lubricating composition is characterized as having (i) a sulfur content of 0.5 wt % or less, (ii) a phosphorus content of 0.15 wt % or less, and (iii) a sulfated ash content of 0.5 wt % to 1.5 wt %.

20. The composition of claim 1, wherein the lubricating composition is characterized as having a total base number (TBN) content of at least 5 mg KOH/g.

21. A process to prepare a salt of an aromatic compound of claim 1 comprising reacting an aromatic compound comprising: reacting an aromatic polyol with a metal base.

22. A process to prepare a salt of an hydroxyl functional aromatic compound of claim 1 comprising (i) reacting an aromatic compound with an epoxide, or a (poly)ether to form an intermediate (or an aromatic polyol), and (ii) reacting the intermediate with a metal base.

23. A method of lubricating an internal combustion engine comprising supplying to the internal combustion engine a lubricating composition including an oil soluble salt comprising:

(a) a conjugate anion of an aromatic compound, the aromatic compound a being neutral salt having a TBN of 130 to 200 mg KOH/g as determined by ASTM D2986-11 with a metal ratio of 0.7 to less than 2 or an overbased salt having a TBN of greater than 200 mg KOH/g as determined by ASTM D2986-11 with a metal ratio of 2 to 5, the aromatic compound being further represented by formula:

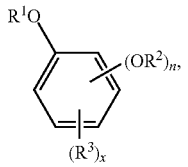

wherein n is 1 or 2, $R^1$ or $R^2$ are each independently hydrogen, a hydrocarbyl group containing 1 to 32 carbon atoms, or $—(CH_2CHR^4—O—)_mR^5$;

$R^3$ is hydrogen, a hydrocarbyl group containing 1 to 150 carbon atoms or a hydrocarbyl group containing 6 to 36 carbon atoms, or an acyl group, $—C(=O)OR^6$, or $—(CH_2CHR^4—O—)_mR^5$;

$R^4$ is hydrogen or a hydrocarbyl group containing 1 to 32 carbon atoms, or $CH_2OR^8$;

$R^5$ is hydrogen or a hydrocarbyl group containing 1 to 24 carbon atoms, or $—(C=O)R^7$;

$R^6$ is a hydrocarbyl group containing 1 to 24 carbon atoms, or $—(CH_2CHR^4—O—)_mR^5$;

$R^7$ may be a hydrocarbyl group containing 1 to 24 carbon atoms;

$R^8$ may be hydrogen or a hydrocarbyl group containing 1 to 24 carbon atoms;

m=1 to 20;

x is 0 to 2, or x is 2 and each $R^3$ is independently a hydrocarbyl group containing at least one carbon atom where together the $R^3$ moieties form a 5- or 6-membered saturated, partially unsaturated or unsaturated hydrocarbyl ring;

with the proviso that at least one of $R^1$, $R^2$ or $R^3$ is not hydrogen and at least one of $R^1$, $R^2$ or $R^5$ is a hydrogen; and (b) a cation having an atomic weight of at least 10.

24. The method of claim 23, wherein the internal combustion engine is selected from a heavy duty diesel internal combustion engine having a technically permissible maximum laden mass over 3,500 kg or a passenger car internal combustion engine having a reference mass not exceeding 2610 kg.

* * * * *